US007097593B2

(12) United States Patent
Chang

(10) Patent No.: US 7,097,593 B2
(45) Date of Patent: Aug. 29, 2006

(54) COMBINATION OF TREADMILL AND STAIR CLIMBING MACHINE

(75) Inventor: Dick Chang, Tai-Chung Hsien (TW)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 10/637,628

(22) Filed: Aug. 11, 2003

(65) Prior Publication Data

US 2005/0037898 A1 Feb. 17, 2005

(51) Int. Cl.
*A63B 22/02* (2006.01)
*A63B 22/04* (2006.01)

(52) U.S. Cl. ..... 482/54; 482/52

(58) Field of Classification Search ..... 482/51–54
See application file for complete search history.

(56) References Cited

U.S. PATENT DOCUMENTS

| | | | |
|---|---|---|---|
| 219,439 | A | 9/1879 | Blend |
| 321,388 | A | 6/1885 | Ruebsam |

(Continued)

FOREIGN PATENT DOCUMENTS

| | | |
|---|---|---|
| AU | 233194 | 8/1959 |
| CA | 644744 | 7/1962 |
| CA | 644774 | 7/1962 |
| CA | 2018219 C | 12/1990 |

(Continued)

OTHER PUBLICATIONS

"A Brief Look At Airpot", Catalog, Airpot Corp., pp. 1–15 (1982).

Damark International, Inc. Mail Order Catalog, dated Nov. 17, 1994, cover page and p. 6.

Treadmill Owner's Manual by Formula 22100 Manual Treadmill, date unknown.

Versatile Exercise System; Abstract from Recreation, Sports & Leisure, p. 10 (1986).

Instruction Booklet for "Body Shop 360" by Weslo International, Inc., pp. 1–30, (1984).

(Continued)

*Primary Examiner*—Stephen R. Crow
(74) *Attorney, Agent, or Firm*—Dorsey & Whitney LLP

(57) ABSTRACT

A combination of treadmill and stair climbing machine includes a single roller supported on a shaft between two lugs on two sides of the frame of the combination and two rear ends of two pedals are respectively connected to the roller and supported on the two lugs. Two front ends of the two pedals are respectively connected to two hydraulic cylinders. A switch member is pivotably connected to a front end of the frame and can be set in a horizontal position when the combination is used as stair climbing machine, and an inclined position when the combination is used as treadmill. An L-shaped plate is connected to the frame and each pedal has a connection plate which has two elongate holes in which two protrusions on each side of the L-shaped plate are movably engaged, such that the pedals are pivotably supported on the L-shaped plate when used as stair climbing machine.

3 Claims, 15 Drawing Sheets

U.S. PATENT DOCUMENTS

| | | | |
|---|---|---|---|
| 625,905 | A | 5/1899 | Souder |
| 663,486 | A | 12/1900 | Boren |
| 683,124 | A | 9/1901 | Lange |
| 756,600 | A | 4/1904 | Dodge |
| 782,010 | A | 2/1905 | Dodge |
| 783,769 | A | 2/1905 | Wright |
| 881,521 | A | 3/1908 | Wilson |
| 931,394 | A | 8/1909 | Day |
| 956,681 | A | 5/1910 | Clarke |
| 1,015,071 | A | 1/1912 | Reach |
| 1,020,777 | A | 3/1912 | Peterson |
| 1,166,304 | A | 12/1915 | Albert |
| 1,239,077 | A | 9/1917 | Begg |
| 1,587,749 | A | 6/1926 | Bierly |
| 1,715,870 | A | 6/1929 | Spain |
| 1,824,406 | A | 9/1931 | Petersime |
| 1,850,530 | A | 3/1932 | Brown |
| 1,870,244 | A | 8/1932 | Elston |
| 1,902,694 | A | 3/1933 | Edwards |
| 1,928,089 | A | 9/1933 | Blickman |
| 1,969,901 | A | 8/1934 | Pilates |
| 1,973,945 | A | 9/1934 | Chavin et al. |
| 2,117,957 | A | 5/1938 | Heller |
| 2,209,034 | A | 7/1940 | Paul |
| 2,239,076 | A | 4/1941 | Biedess |
| 2,239,687 | A | 4/1941 | Parker |
| 2,251,766 | A | 8/1941 | Stark |
| 2,315,485 | A | 4/1943 | Jones III |
| 2,374,730 | A | 5/1945 | Catlin |
| 2,380,221 | A | 7/1945 | Cundall |
| 2,399,915 | A | 5/1946 | Drake |
| 2,425,860 | A | 8/1947 | Brady |
| 2,434,760 | A | 1/1948 | Eggleston |
| 2,603,486 | A | 7/1952 | Hughes |
| 2,812,180 | A | 11/1957 | Cymbal |
| 2,847,114 | A | 8/1958 | Orr |
| 2,855,200 | A | 10/1958 | Blickman |
| 2,866,538 | A | 12/1958 | Goldberg |
| 2,914,957 | A | 12/1959 | Johnson |
| 2,969,768 | A | 1/1961 | Grant |
| 2,996,295 | A | 8/1961 | Smith |
| 3,022,433 | A | 2/1962 | Ferranti |
| 3,127,171 | A | 3/1964 | Noland et al. |
| 3,295,847 | A | 1/1967 | Matt, Sr. |
| 3,312,466 | A | 4/1967 | Melchiona |
| D207,541 | S | 5/1967 | Hesen |
| 3,316,898 | A | 5/1967 | Brown |
| 3,319,767 | A | 5/1967 | Breternitz et al. |
| 3,348,678 | A | 10/1967 | Flowers |
| 3,378,259 | A | 4/1968 | Kupchinski |
| D211,801 | S | 7/1968 | Quinton |
| 3,408,067 | A | 10/1968 | Armstrong |
| 3,427,019 | A | 2/1969 | Brown |
| 3,432,164 | A | 3/1969 | Deeks |
| 3,444,830 | A | 5/1969 | Doetsch |
| 3,473,843 | A | 10/1969 | Hart |
| 3,497,215 | A | 2/1970 | Harrison et al. |
| 3,501,040 | A | 3/1970 | Martelee |
| 3,501,140 | A | 3/1970 | Eichom |
| 3,511,500 | A | 5/1970 | Dunn |
| 3,525,522 | A | 8/1970 | Piller |
| 3,529,474 | A | 9/1970 | Olson et al. |
| 3,559,986 | A | 2/1971 | Ehrmantraut |
| 3,586,322 | A | 6/1971 | Kvermeland |
| 3,589,715 | A | 6/1971 | Mark |
| 3,590,980 | A | 7/1971 | Bengtsson |
| 3,592,466 | A | 7/1971 | Parsons |
| 3,602,502 | A | 8/1971 | Hampl |
| 3,614,097 | A | 10/1971 | Blickman |
| 3,627,313 | A | 12/1971 | Schonfeld |
| 3,628,654 | A | 12/1971 | Haracz |
| 3,638,941 | A | 2/1972 | Kulkens |
| 3,642,279 | A | 2/1972 | Cutter |
| 3,643,943 | A | 2/1972 | Erwin, Jr. et al. |
| 3,647,209 | A | 3/1972 | La Lanne |
| 3,659,845 | A | 5/1972 | Quinton |
| 3,689,066 | A | 9/1972 | Hagen |
| 3,703,284 | A | 11/1972 | Hesen |
| 3,709,487 | A | 1/1973 | Walker |
| 3,711,812 | A | 1/1973 | Cherry |
| 3,718,120 | A | 2/1973 | Schwarz et al. |
| 3,731,917 | A | 5/1973 | Townsend |
| 3,741,538 | A | 6/1973 | Lewis et al. |
| 3,741,540 | A | 6/1973 | Shimizu |
| 3,747,924 | A | 7/1973 | Champoux |
| 3,756,595 | A | 9/1973 | Hague |
| 3,759,511 | A | 9/1973 | Zinkin et al. |
| 3,770,267 | A | 11/1973 | McCarthy |
| 3,814,420 | A | 6/1974 | Encke |
| 3,824,067 | A | 7/1974 | Voshel |
| 3,824,961 | A | 7/1974 | Webb |
| 3,826,491 | A | 7/1974 | Elder |
| 3,870,297 | A | 3/1975 | Elder |
| 3,874,657 | A | 4/1975 | Niebojewski |
| 3,892,404 | A | 7/1975 | Martucci |
| 3,896,925 | A | 7/1975 | Mitsui et al. |
| 3,918,710 | A | 11/1975 | Niebojewski |
| 3,948,351 | A | 4/1976 | Baumann |
| 3,956,976 | A | 5/1976 | Vogel et al. |
| 3,962,595 | A | 6/1976 | Eddens |
| 3,963,101 | A | 6/1976 | Stadelmann et al. |
| 3,966,182 | A | 6/1976 | Stadelmann et al. |
| 3,970,302 | A | 7/1976 | McFee |
| 3,994,261 | A | 11/1976 | Wedell et al. |
| 4,023,466 | A | 5/1977 | Strassheimer |
| 4,026,545 | A | 5/1977 | Schonenberger |
| 4,063,726 | A | 12/1977 | Wilson |
| 4,066,257 | A | 1/1978 | Moller |
| 4,070,427 | A | 1/1978 | Romualdi et al. |
| 4,072,309 | A | 2/1978 | Wilson |
| 4,085,344 | A | 4/1978 | Eddens |
| 4,087,088 | A | 5/1978 | Kelso |
| 4,093,196 | A | 6/1978 | Bauer |
| 4,095,371 | A | 6/1978 | Knippel |
| 4,131,266 | A | 12/1978 | Carter |
| 4,140,312 | A | 2/1979 | Buchmann |
| 4,146,222 | A | 3/1979 | Hribar |
| 4,151,988 | A | 5/1979 | Nabinger |
| 4,157,179 | A | 6/1979 | Ecklor, Jr. |
| 4,185,622 | A | 1/1980 | Swenson |
| 4,194,442 | A | 3/1980 | Martelli |
| 4,204,673 | A | 5/1980 | Speer, Sr. |
| 4,240,627 | A | 12/1980 | Brentham |
| 4,248,476 | A | 2/1981 | Phelps |
| 4,270,749 | A | 6/1981 | Hebern |
| 4,300,761 | A | 11/1981 | Howard |
| 4,316,609 | A | 2/1982 | Silberman |
| 4,319,747 | A | 3/1982 | Rogers |
| D263,978 | S | 4/1982 | Brentham |
| 4,334,676 | A | 6/1982 | Schonenberger |
| 4,344,616 | A | 8/1982 | Ogden |
| 4,350,336 | A | 9/1982 | Hanford |
| 4,350,913 | A | 9/1982 | Eddens |
| 4,358,105 | A | 11/1982 | Sweeney, Jr. |
| 4,363,480 | A | 12/1982 | Fisher et al. |
| 4,364,556 | A | 12/1982 | Otte |
| 4,369,966 | A | 1/1983 | Silberman et al. |
| 4,370,766 | A | 2/1983 | Teague, Jr. |
| 4,374,587 | A | 2/1983 | Ogden |
| 4,383,714 | A | 5/1983 | Ishida |
| 4,411,342 | A | 10/1983 | Katsumori et al. |

4,422,635 A 12/1983 Herod et al.
4,423,864 A 1/1984 Wiik
4,072,309 A 3/1984 Wilson
4,445,683 A 5/1984 Ogden
4,452,448 A 6/1984 Ausherman
4,456,276 A 6/1984 Bortolin
4,462,252 A 7/1984 Smidt et al.
4,470,597 A 9/1984 McFee
4,477,071 A 10/1984 Brown et al.
4,480,832 A 11/1984 Bulmash et al.
4,492,375 A 1/1985 Connelly
4,502,679 A 3/1985 De Lorenzo
4,509,510 A 4/1985 Hook
4,509,742 A 4/1985 Cones
4,521,013 A 6/1985 Dofel
D280,224 S 8/1985 Wilson
4,544,152 A 10/1985 Taitel
4,555,109 A 11/1985 Hartmann
4,561,318 A 12/1985 Schirrmacher
4,563,001 A 1/1986 Terauds
4,566,689 A 1/1986 Ogden
4,572,500 A 2/1986 Weiss
4,576,352 A 3/1986 Ogden
D283,239 S 4/1986 Smith et al.
4,582,320 A 4/1986 Shaw
4,588,065 A 5/1986 Maiden et al.
4,591,147 A 5/1986 Smith et al.
D284,597 S 7/1986 Smith et al.
4,600,187 A 7/1986 Schenker
4,600,196 A 7/1986 Jones
4,602,779 A 7/1986 Ogden
4,614,337 A 9/1986 Schonenberger
4,616,822 A 10/1986 Trulaske et al.
4,618,144 A 10/1986 Gibson
4,620,704 A 11/1986 Shifferaw
4,621,623 A 11/1986 Wang
4,625,962 A 12/1986 Street
4,627,619 A 12/1986 Rockwell et al.
4,629,062 A 12/1986 Silverthorn et al.
4,632,385 A 12/1986 Geraci
4,635,927 A 1/1987 Shu
4,635,928 A 1/1987 Ogden et al.
4,643,418 A 2/1987 Bart
4,645,195 A 2/1987 Scranton et al.
4,645,197 A 2/1987 McFee
4,645,200 A 2/1987 Hix
4,659,074 A 4/1987 Taitel et al.
4,659,077 A 4/1987 Stropkay
4,660,247 A 4/1987 Frohbieter et al.
D289,668 S 5/1987 Gremonprez et al.
4,664,371 A 5/1987 Viander
4,664,646 A 5/1987 Rorabaugh
4,679,786 A 7/1987 Rodgers
4,679,787 A 7/1987 Guilbault
4,681,316 A 7/1987 DeCloux
4,685,666 A 8/1987 DeCloux
4,687,195 A 8/1987 Potts
4,690,398 A 9/1987 Smith
4,693,363 A 9/1987 Kuehnert
4,696,357 A 9/1987 Beehler et al.
4,708,337 A 11/1987 Shyu
4,708,338 A 11/1987 Potts
4,720,093 A 1/1988 Del Mar
4,725,057 A 2/1988 Shifferaw
4,726,583 A 2/1988 Olsen et al.
4,729,558 A 3/1988 Kuo
4,733,858 A 3/1988 Lan
4,749,181 A 6/1988 Pittaway et al.
4,750,735 A 6/1988 Furgerson et al.
4,757,987 A 7/1988 Allemand
4,759,540 A 7/1988 Yu et al.
4,766,996 A 8/1988 Gibson
4,786,049 A 11/1988 Lautenschlager
4,786,050 A 11/1988 Geschwender
4,792,134 A 12/1988 Chen
4,796,881 A 1/1989 Watterson
4,799,676 A 1/1989 Sheppard et al.
4,805,901 A 2/1989 Kulick
4,813,667 A 3/1989 Watterson
4,819,583 A 4/1989 Guerra
4,826,153 A 5/1989 Schalip
4,830,362 A 5/1989 Bull
4,836,543 A 6/1989 Holzer
4,838,543 A 6/1989 Armstrong et al.
4,842,266 A 6/1989 Sweeney, Sr. et al.
4,844,449 A 7/1989 Truslaske
4,848,737 A 7/1989 Ehrenfield
4,852,874 A 8/1989 Sleichter, III et al.
4,854,577 A 8/1989 Sims
4,860,634 A 8/1989 Hein
D303,414 S 9/1989 Armstrong et al.
4,869,494 A 9/1989 Lambert, Sr.
D304,849 S 11/1989 Watterson
4,881,934 A 11/1989 Harston et al.
4,886,266 A 12/1989 Trulaske
4,900,013 A 2/1990 Rodgers, Jr.
D306,468 S 3/1990 Watterson
D306,891 S 3/1990 Watterson
4,905,330 A 3/1990 Jacobs
4,913,396 A 4/1990 Dalebout et al.
4,913,423 A 4/1990 Farran et al.
4,918,766 A 4/1990 Leonaggeo, Jr.
4,921,247 A 5/1990 Sterling
4,927,138 A 5/1990 Ferrari
4,928,959 A 5/1990 Bassett et al.
4,938,473 A 7/1990 Lee et al.
4,938,475 A 7/1990 Sargeant et al.
4,940,233 A 7/1990 Bull et al.
4,944,518 A 7/1990 Flynn
4,949,954 A 8/1990 Hix
4,949,993 A 8/1990 Stark et al.
4,959,040 A 9/1990 Gardner et al.
4,974,831 A 12/1990 Dunham
D313,826 S 1/1991 Birrell et al.
4,981,136 A 1/1991 Chance
4,984,810 A 1/1991 Stearns et al.
4,989,857 A 2/1991 Kuo
4,989,858 A 2/1991 Young et al.
D315,765 S 3/1991 Measom et al.
4,998,725 A 3/1991 Watterson et al.
5,000,440 A 3/1991 Lynch
5,000,443 A 3/1991 Dalebout et al.
5,002,271 A 3/1991 Gonzales
D316,124 S 4/1991 Dalebout et al.
5,007,528 A 4/1991 Hideharu
5,007,630 A 4/1991 Real et al.
5,019,029 A 5/1991 Calvert
5,026,046 A 6/1991 DeCloux
D318,085 S 7/1991 Jacobson et al.
D318,699 S 7/1991 Jacobson et al.
5,028,801 A 7/1991 Gerdt
5,029,801 A 7/1991 Dalebout et al.
5,039,087 A 8/1991 Kuo
5,039,088 A 8/1991 Shifferaw
5,040,786 A 8/1991 Jou
5,048,821 A 9/1991 Kuo-Liang
5,054,770 A 10/1991 Bull
5,058,881 A 10/1991 Measom
5,058,882 A 10/1991 Dalebout et al.
5,061,231 A 10/1991 Dietrich et al.
D321,388 S 11/1991 Dalebout
D321,734 S 11/1991 Dunham et al.

5,062,626 A 11/1991 Dalebout et al.
5,062,627 A 11/1991 Bingham
5,067,937 A 11/1991 Aschaber et al.
5,071,115 A 12/1991 Welch
5,072,928 A 12/1991 Stearns et al.
D323,009 S 1/1992 Dalebout et al.
D323,198 S 1/1992 Dalebout et al.
D323,199 S 1/1992 Dalebout et al.
5,078,389 A 1/1992 Chen
5,078,669 A 1/1992 Dietrich et al.
5,081,991 A 1/1992 Chance
5,085,426 A 2/1992 Wanzer et al.
5,088,729 A 2/1992 Dalebout
5,090,690 A 2/1992 Huang
5,094,449 A 3/1992 Stearns
5,094,450 A 3/1992 Stearns
5,100,127 A 3/1992 Melnick et al.
5,102,380 A 4/1992 Jacobson et al.
5,102,385 A 4/1992 Calvert
5,104,120 A 4/1992 Watterson et al.
5,105,931 A 4/1992 Lashyro
D326,491 S 5/1992 Dalebout
5,109,778 A 5/1992 Berkowitz et al.
5,110,117 A 5/1992 Fisher et al.
5,114,388 A 5/1992 Trulaske
5,114,389 A 5/1992 Brentham
5,129,872 A 7/1992 Dalton et al.
5,129,873 A 7/1992 Henderson et al.
5,131,895 A 7/1992 Rogers, Jr.
D328,770 S 8/1992 Henderson et al.
5,135,216 A 8/1992 Bingham et al.
5,135,447 A 8/1992 Robards, Jr. et al.
5,139,469 A 8/1992 Hennessey et al.
5,139,470 A 8/1992 Wang
5,141,479 A 8/1992 Vanjani et al.
5,145,481 A 9/1992 Friedebach
5,149,084 A 9/1992 Dalebout et al.
5,160,302 A 11/1992 Li
5,162,029 A 11/1992 Gerard
5,163,885 A 11/1992 Wanzer et al.
5,163,888 A 11/1992 Stearns
5,171,196 A 12/1992 Lynch
5,180,353 A 1/1993 Snyderman
5,183,448 A 2/1993 Wang
5,183,449 A 2/1993 DeCloux
5,184,988 A 2/1993 Dunham
5,186,697 A 2/1993 Rennex
5,188,577 A 2/1993 Young et al.
5,190,505 A 3/1993 Dalebout et al.
5,192,255 A 3/1993 Dalebout et al.
5,199,932 A 4/1993 Liao
5,199,934 A 4/1993 Lin
5,203,800 A 4/1993 Meredith
5,203,826 A 4/1993 Dalebout
5,205,800 A 4/1993 Grant
4,913,396 A 5/1993 Dalebout et al.
5,207,621 A 5/1993 Koch et al.
5,207,622 A 5/1993 Wilkinson et al.
5,207,628 A 5/1993 Graham
5,209,714 A 5/1993 Sainte et al.
5,215,515 A 6/1993 Bershadsky
5,226,866 A 7/1993 Engel et al.
5,232,421 A 8/1993 Chen et al.
5,236,407 A 8/1993 Wang
5,242,343 A 9/1993 Miller
5,246,410 A 9/1993 Fun
5,247,853 A 9/1993 Dalebout
5,251,742 A 10/1993 Campbell
5,254,067 A 10/1993 Habing et al.
5,256,117 A 10/1993 Potts et al.
5,263,910 A 11/1993 Yang
5,267,923 A 12/1993 Piaget et al.
5,277,677 A 1/1994 Terauds
5,279,528 A 1/1994 Dalebout et al.
5,279,529 A 1/1994 Eschenbach
D344,557 S 2/1994 Ashby
5,282,776 A 2/1994 Dalebout
5,282,992 A 2/1994 Reichgott
5,290,204 A 3/1994 Lee
5,290,205 A 3/1994 Densmore et al.
5,290,211 A 3/1994 Stearns
5,295,928 A 3/1994 Rennex
5,299,992 A 4/1994 Wilkinson
5,299,993 A * 4/1994 Habing ..... 482/52
5,302,162 A 4/1994 Pasero
5,304,105 A 4/1994 Hsieh
5,318,487 A 6/1994 Golen et al.
5,318,490 A 6/1994 Henderson et al.
5,320,588 A 6/1994 Wanzer et al.
5,322,491 A 6/1994 Wanzer et al.
5,323,784 A 6/1994 Shu
D348,493 S 7/1994 Ashby
D348,494 S 7/1994 Ashby
5,330,397 A 7/1994 Prince et al.
5,330,401 A 7/1994 Walstead
5,335,146 A 8/1994 Stucke
5,336,141 A 8/1994 Vittone
5,336,142 A 8/1994 Dalebout et al.
5,336,144 A 8/1994 Rodden
5,336,145 A 8/1994 Keiser
5,336,146 A * 8/1994 Piaget et al. ..... 482/54
5,338,271 A 8/1994 Wang
5,344,371 A 9/1994 Wang
5,346,447 A 9/1994 Stearns
5,346,452 A 9/1994 Ku
D351,202 S 10/1994 Bingham
D351,633 S 10/1994 Bingham
5,352,167 A 10/1994 Ulicny
5,352,169 A 10/1994 Eschenbach
5,368,532 A 11/1994 Farnet
5,372,559 A 12/1994 Dalebout et al.
5,372,560 A 12/1994 Chang
5,374,227 A 12/1994 Webb
5,192,255 A 1/1995 Dalebout et al.
5,382,207 A 1/1995 Skowronski et al.
5,383,829 A 1/1995 Miller
5,401,226 A 3/1995 Stearns
RE34,959 E 5/1995 Potts
5,411,454 A 5/1995 Chang
5,419,747 A 5/1995 Piaget et al.
4,913,396 A 6/1995 Dalebout et al.
5,423,729 A 6/1995 Eschenbach
5,429,563 A 7/1995 Engel et al.
5,431,612 A 7/1995 Holden
D360,915 S 8/1995 Bostic et al.
5,441,467 A 8/1995 Stevens
5,441,468 A 8/1995 Deckers et al.
5,445,583 A 8/1995 Habing
5,454,772 A 10/1995 Rodden
5,462,504 A 10/1995 Trulaske et al.
5,476,430 A 12/1995 Lee et al.
5,480,365 A 1/1996 Lundin et al.
5,484,362 A 1/1996 Skowronski et al.
5,489,250 A 2/1996 Densmore et al.
5,492,517 A 2/1996 Bostic et al.
5,496,235 A 3/1996 Stevens
5,499,956 A 3/1996 Habing et al.
5,509,872 A 4/1996 Chen
5,512,025 A 4/1996 Dalebout et al.
5,514,068 A 5/1996 Calvert et al.
5,518,470 A 5/1996 Piaget et al.
5,518,473 A 5/1996 Miller 5,527,245 A 6/1996 Dalebout et al.
5,527,246 A 6/1996 Rodgers, Jr.
5,529,553 A 6/1996 Finlayson
5,529,555 A 6/1996 Rodgers, Jr.
5,536,224 A 7/1996 Hsieh
5,536,231 A 7/1996 Nilsson
5,538,489 A 7/1996 Magid
5,540,637 A 7/1996 Rodgers, Jr.
5,542,892 A 8/1996 Buhler
5,545,112 A 8/1996 Densmore et al.
5,549,526 A 8/1996 Rodgers, Jr.
D373,805 S 9/1996 Rawls et al.
5,558,604 A 9/1996 Hopkins
5,562,574 A 10/1996 Miller
5,573,480 A 11/1996 Rodgers, Jr.
5,577,985 A 11/1996 Miller
D376,828 S 12/1996 Conley et al.
5,584,781 A 12/1996 Chen
5,591,106 A 1/1997 Dalebout et al.
5,591,107 A 1/1997 Rodgers, Jr.
5,593,371 A 1/1997 Rodgers, Jr.
5,593,372 A 1/1997 Rodgers, Jr.
5,595,553 A 1/1997 Rodgers, Jr.
5,595,554 A 1/1997 Maresh
5,595,555 A 1/1997 Chen
5,595,556 A 1/1997 Dalebout et al.
5,599,259 A 2/1997 Skowronski et al.
5,605,521 A 2/1997 Hsieh
5,607,375 A 3/1997 Dalebout et al.
5,611,756 A 3/1997 Miller
5,611,757 A 3/1997 Rodgers, Jr.
5,611,758 A 3/1997 Rodgers, Jr.
5,613,924 A 3/1997 Lee
5,622,527 A 4/1997 Watterson et al.
5,624,354 A 4/1997 Chen
5,626,538 A 5/1997 Dalebout et al.
5,626,539 A * 5/1997 Piaget et al. ..... 482/54
5,637,058 A 6/1997 Rodgers, Jr.
5,643,140 A 7/1997 Tsai
5,643,153 A 7/1997 Nylen et al.
5,645,512 A 7/1997 Yu
5,649,882 A 7/1997 Parikh et al.
5,650,709 A 7/1997 Rotunda et al.
5,653,662 A 8/1997 Rodgers, Jr.
5,655,998 A 8/1997 Yu
5,658,223 A 8/1997 Habing et al.
5,658,227 A 8/1997 Stearns
5,662,557 A 9/1997 Watterson et al.
5,665,033 A 9/1997 Palmer
5,669,856 A 9/1997 Liu
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,332 A 11/1997 Watterson et al.
5,683,333 A 11/1997 Rodgers, Jr.
5,685,804 A 11/1997 Whan-Tong et al.
5,690,589 A 11/1997 Rodgers, Jr.
5,702,305 A 12/1997 Norman et al.
5,702,325 A 12/1997 Watterson et al.
5,704,879 A 1/1998 Watterson et al.
5,707,321 A 1/1998 Maresh
5,708,060 A 1/1998 Sands et al.
5,709,632 A 1/1998 Socwell
5,711,745 A 1/1998 Yang
5,718,657 A 2/1998 Dalebout et al.
5,720,698 A 2/1998 Dalebout et al.
5,722,922 A 3/1998 Watterson et al.
5,733,227 A 3/1998 Lee
5,738,614 A 4/1998 Rodgers, Jr.
5,741,205 A 4/1998 Doll et al.
5,743,833 A 4/1998 Watterson et al.
5,743,834 A 4/1998 Rodgers, Jr.
5,746,682 A 5/1998 Hung
5,747,955 A 5/1998 Rotunda et al.
5,749,807 A 5/1998 Webb
5,752,897 A 5/1998 Skowronski et al.
5,755,642 A 5/1998 Miller
5,759,135 A 6/1998 Chen
5,759,136 A 6/1998 Chen
5,762,587 A 6/1998 Dalebout et al.
5,762,588 A 6/1998 Chen
5,766,113 A 6/1998 Rodgers, Jr.
5,772,558 A 6/1998 Rodgers, Jr.
5,772,560 A 6/1998 Watterson et al.
5,779,598 A 7/1998 Lee
5,779,599 A 7/1998 Chen
5,782,723 A 7/1998 Kuo
5,788,609 A 8/1998 Miller
5,792,026 A 8/1998 Maresh et al.
5,792,029 A 8/1998 Gordon
5,803,870 A 9/1998 Buhler
5,803,871 A 9/1998 Stearns et al.
5,803,872 A 9/1998 Chang
5,803,880 A 9/1998 Allen
5,810,696 A 9/1998 Webb
5,813,949 A 9/1998 Rodgers, Jr.
5,827,155 A 10/1998 Jensen et al.
D400,941 S 11/1998 Allen
5,836,855 A 11/1998 Eschenbach
5,848,954 A 12/1998 Stearns et al.
5,853,352 A 12/1998 Login
5,855,537 A 1/1999 Coody et al.
5,856,736 A 1/1999 Rotunda et al.
5,857,941 A 1/1999 Maresh et al.
5,860,893 A 1/1999 Watterson et al.
5,860,894 A 1/1999 Dalebout et al.
5,865,712 A 2/1999 Chang
D406,621 S 3/1999 Piaget
5,876,307 A 3/1999 Stearns et al.
5,879,270 A 3/1999 Huish et al.
5,879,271 A 3/1999 Stearns et al.
5,882,281 A 3/1999 Stearns et al.
D407,771 S 4/1999 Garza
5,890,997 A 4/1999 Roth
5,893,820 A 4/1999 Maresh et al.
5,895,339 A 4/1999 Maresh
5,897,459 A 4/1999 Habing et al.
5,899,833 A 5/1999 Ryan et al.
5,899,834 A 5/1999 Dalebout et al.
5,908,373 A 6/1999 Pitre
5,910,072 A 6/1999 Rawls et al.
5,911,649 A 6/1999 Miller
5,913,751 A 6/1999 Eschenbach
5,916,065 A 6/1999 McBride et al.
5,919,118 A 7/1999 Stearns et al.
5,921,894 A 7/1999 Eschenbach
5,924,962 A 7/1999 Rodgers, Jr.
5,924,963 A 7/1999 Maresh et al.
D412,953 S 8/1999 Armstrong
5,938,567 A 8/1999 Rodgers, Jr.
5,938,568 A 8/1999 Maresh et al.
5,938,570 A 8/1999 Maresh
5,938,575 A 8/1999 Stearns
5,944,638 A 8/1999 Maresh et al.
5,947,872 A 9/1999 Ryan et al.
5,951,441 A 9/1999 Dalebout et al.
5,964,682 A 10/1999 Sokol
D416,596 S 11/1999 Armstrong
5,989,163 A 11/1999 Rodgers, Jr.
5,993,359 A 11/1999 Eschenbach 5,997,445 A 12/1999 Maresh et al.
5,997,446 A 12/1999 Stearns
6,013,011 A 1/2000 Moore et al.
6,019,710 A 2/2000 Dalebout et al.
6,027,430 A 2/2000 Stearns et al.
6,027,431 A 2/2000 Stearns et al.
6,030,320 A 2/2000 Stearns et al.
D421,779 S 3/2000 Piaget et al.
6,033,344 A 3/2000 Trulaske et al.
6,033,347 A 3/2000 Dalebout et al.
6,042,512 A 3/2000 Eschenbach
6,042,514 A 3/2000 Abelbeck
6,042,518 A 3/2000 Hildebrandt et al.
6,045,487 A 4/2000 Miller
6,045,488 A 4/2000 Eschenbach
6,050,921 A 4/2000 Wang
6,053,847 A 4/2000 Stearns et al.
D424,137 S 5/2000 Barker et al.
6,063,009 A 5/2000 Stearns et al.
6,066,073 A 5/2000 Stearns et al.
6,077,196 A 6/2000 Eschenbach
6,077,197 A 6/2000 Stearns et al.
6,077,198 A 6/2000 Eschenbach
6,080,086 A 6/2000 Maresh et al.
6,090,014 A 7/2000 Eschenbach
D429,509 S 8/2000 Garza
6,095,951 A 8/2000 Skowronski et al.
6,106,439 A 8/2000 Boland
6,113,518 A 9/2000 Maresh et al.
6,117,053 A 9/2000 Chiu
6,123,646 A 9/2000 Colassi
6,123,650 A 9/2000 Birrell
6,126,574 A 10/2000 Stearns et al.
6,132,340 A 10/2000 Wang et al.
6,135,923 A 10/2000 Stearns et al.
6,135,925 A 10/2000 Liu
6,152,859 A 11/2000 Stearns
6,165,107 A 12/2000 Birrell
6,168,552 B1 1/2001 Eschenbach
6,171,215 B1 1/2001 Stearns et al.
6,171,217 B1 1/2001 Cutler
6,174,267 B1 1/2001 Dalebout et al.
6,176,814 B1 1/2001 Ryan et al.
6,179,753 B1 1/2001 Barker et al.
6,183,397 B1 2/2001 Stearns et al.
6,183,398 B1 2/2001 Rufino et al.
6,190,289 B1 2/2001 Pyles et al.
6,196,948 B1 3/2001 Stearns et al.
6,206,804 B1 3/2001 Maresh
6,206,806 B1 3/2001 Chu
6,206,809 B1 3/2001 Habing et al.
6,210,305 B1 4/2001 Eschenbach
6,217,486 B1 4/2001 Rosenow
6,234,936 B1 5/2001 Wang
6,248,044 B1 6/2001 Stearns et al.
6,248,045 B1 6/2001 Stearns et al.
6,248,046 B1 6/2001 Maresh et al.
6,251,047 B1 6/2001 Stearns et al.
D445,152 S 7/2001 Wang et al.
6,254,514 B1 7/2001 Maresh et al.
6,258,012 B1 7/2001 Yoshimura
6,261,209 B1 7/2001 Coody
6,280,362 B1 8/2001 Dalebout et al.
6,283,895 B1 9/2001 Stearns et al.
6,302,825 B1 10/2001 Stearns et al.
6,302,830 B1 10/2001 Stearns
6,302,832 B1 10/2001 Stearns
D450,792 S 11/2001 Kuo
6,312,362 B1 11/2001 Maresh et al.
6,312,363 B1 11/2001 Watterson et al.
6,328,676 B1 12/2001 Alessandri
6,340,340 B1 1/2002 Stearns et al.
D453,543 S 2/2002 Cutler
D453,948 S 2/2002 Cutler
6,350,218 B1 2/2002 Dalebout et al.
5,383,829 C1 3/2002 Miller
6,361,476 B1 3/2002 Eschenbach
D455,152 S 4/2002 Caughlan et al.
6,398,695 B1 6/2002 Miller
6,413,195 B1 7/2002 Barzelay
6,436,008 B1 8/2002 Skowronski et al.
6,447,424 B1 9/2002 Ashby et al.
6,450,923 B1 9/2002 Vatti
6,458,060 B1 10/2002 Watterson et al.
6,461,279 B1 * 10/2002 Kuo ..... 482/54
6,471,622 B1 10/2002 Hammer et al.
6,503,173 B1 1/2003 Clem
6,554,750 B1 4/2003 Stearns et al.
6,569,062 B1 5/2003 Wang et al.
6,572,512 B1 6/2003 Anderson et al.
6,572,513 B1 6/2003 Whan-Tong et al.
6,589,138 B1 7/2003 Dyer et al.
6,612,969 B1 9/2003 Eschenbach
6,626,803 B1 9/2003 Oglesby et al.
D482,085 S 11/2003 Eyler et al.
6,645,124 B1 11/2003 Clem
6,652,424 B1 11/2003 Dalebout
6,689,019 B1 2/2004 Ohrt et al.
6,695,581 B1 2/2004 Wasson et al.
6,730,002 B1 5/2004 Hald et al.
6,743,153 B1 6/2004 Watterson et al.
6,761,667 B1 7/2004 Cutler et al.
6,783,482 B1 8/2004 Oglesby et al.
6,786,852 B1 9/2004 Watterson et al.
6,811,517 B1 11/2004 Eschenbach
6,821,230 B1 11/2004 Dalebout et al.
6,830,540 B1 12/2004 Watterson et al.
6,837,829 B1 1/2005 Eschenbach
6,875,160 B1 4/2005 Watterson et al.
6,878,099 B1 4/2005 Corbalis et al.
6,899,659 B1 5/2005 Anderson et al.
6,923,746 B1 8/2005 Skowronski et al.
2001/0011053 A1 8/2001 Miller
2001/0016542 A1 8/2001 Yoshimura
2001/0049323 A1 12/2001 Fox
2002/0016235 A1 2/2002 Ashby et al.
2002/0082146 A1 6/2002 Stearns
2003/0040405 A1 2/2003 Watterson et al.
2003/0045401 A1 3/2003 Watterson et al.
2003/0073545 A1 4/2003 Liu et al.
2003/0125165 A1 7/2003 Trevino et al.
2003/0139261 A1 7/2003 Kuo
2003/0153434 A1 8/2003 Dalebout et al.
2004/0018915 A1 1/2004 Reyes et al.
2004/0018916 A1 1/2004 Marin et al.
2004/0018917 A1 1/2004 Corbalis et al.
2004/0018918 A1 1/2004 Reyes et al.
2004/0132583 A1 7/2004 Ohrt et al.
2004/0162191 A1 8/2004 Ercanbrack et al.
2004/0180757 A1 9/2004 Levi
2004/0192514 A1 9/2004 Plaget et al.
2004/0209738 A1 10/2004 Crawford et al.
2004/0248709 A1 12/2004 Rodgers, Jr.
2005/0026752 A1 2/2005 Lull et al.
2005/0202939 A1 9/2005 Lull et al.
2005/0209059 A1 9/2005 Crawford et al.
2005/0209060 A1 9/2005 Lull
2005/0209061 A1 9/2005 Crawford et al.
2005/0233864 A1 10/2005 Smith et al.

FOREIGN PATENT DOCUMENTS

CA 2016756 C 1/1991

| | | | | |
|---|---|---|---|---|
| CA | 2061470 | C | | 9/1992 |
| CA | 2143341 | C | | 9/1995 |
| CH | 191377 | | | 6/1937 |
| DE | 2 163 289 | A1 | | 7/1972 |
| DE | 22 25 342 | | | 12/1973 |
| DE | 24 08 052 | A | | 8/1975 |
| DE | 24 08 055 | | | 8/1975 |
| DE | 24 28 515 | A | | 1/1976 |
| DE | 25 28 414 | A1 | | 5/1976 |
| DE | 29 19 494 | A1 | | 11/1980 |
| DE | 36 01 184 | A1 | | 7/1987 |
| DE | 38 39 391 | A1 | | 6/1989 |
| DE | 4 003 869 | A1 | | 8/1991 |
| DE | 4 003 871 | A1 | | 8/1991 |
| DE | 41 00 066 | A1 | | 9/1991 |
| DE | 43 37 874 | A1 | | 5/1994 |
| DE | 43 37 875 | A1 | | 5/1994 |
| DE | 94 03 959 | U1 | | 5/1994 |
| EP | 0 196 877 | A2 | | 10/1986 |
| EP | 0 225 810 | A1 | | 6/1987 |
| EP | 0 334 608 | A2 | | 9/1989 |
| EP | 0 403 924 | A2 | | 12/1990 |
| EP | 0 417 970 | A1 | | 3/1991 |
| EP | 0 504 649 | A1 | | 9/1992 |
| EP | 0 914 842 | A2 | | 5/1999 |
| FR | 1 432 392 | | | 9/1966 |
| FR | 1 565 617 | | | 3/1969 |
| FR | 2 616 132 | | | 12/1988 |
| FR | 2 623 410 | | | 5/1989 |
| GB | 1 367 447 | | | 9/1974 |
| GB | 1 505 702 | | | 3/1978 |
| GB | 1 526 742 | | | 9/1978 |
| GB | 2 152 825 | A | | 8/1985 |
| GB | 2 184 361 | A | | 6/1987 |
| GB | 2 212 729 | A | | 2/1989 |
| GB | 2 241 176 | A | | 8/1991 |
| GB | 2 270 007 | A | | 3/1994 |
| GB | 2 272 167 | A | | 5/1994 |
| JP | 51-10842 | | | 3/1976 |
| SE | 58 213 | | | 6/1995 |
| SE | 66 279 | | | 10/2000 |
| SE | 66 280 | | | 10/2000 |
| SU | 546 523 | | | 3/1977 |
| SU | 1248617 | A1 | | 8/1986 |
| SU | 1256755 | A1 | | 9/1986 |
| SU | 1 265 113 | A1 | | 10/1986 |
| SU | 1 297 879 | A1 | | 3/1987 |
| SU | 1321430 | A1 | | 7/1987 |
| SU | 1347953 | A2 | | 10/1987 |
| SU | 1 567 221 | A1 | | 5/1990 |
| TW | 472593 | | * | 1/2002 |
| TW | 507582 | | * | 10/2002 |
| TW | 547102 | | | 8/2003 |
| WO | WO 81/01960 | | | 7/1981 |
| WO | WO 82/01138 | | | 4/1982 |
| WO | WO 89/07473 | | * | 8/1989 |
| WO | WO 92/11905 | | | 7/1992 |
| WO | WO 94/20170 | | | 9/1994 |
| WO | WO 95/16502 | | | 6/1995 |
| WO | WO 99/21620 | | | 5/1999 |
| WO | WO 00/06256 | | | 2/2000 |
| WO | WO 00/18472 | | | 4/2000 |
| WO | WO 00/30717 | | | 6/2000 |

OTHER PUBLICATIONS

Owner's Manual for Weider Flex CTS Cross Training System for Model No. 870300, Weslo, Inc., a Weider Heal and Fitness, Inc. Company, pp. 1–12 (Mar. 1990).

Catalog, Diamond House International Inc., date unknown.

J.K. Exer, Catalog, Jih Kao Ent. Co., Ltd., Date unknown.

inshape, "A fitness machine for all reasons", relating to Precor C544, 1 page, undated.*

"New Cardio Machines: Good for the Heart and Mind", Noah Liberman, *HG&F,* relates to Precor C544 Transport, 1 page, undated.*

*Health and Fitness,* "Get Elliptical", 1 page, undated, but before mid–1996.*

Profiles In Quality, "Precor: Work Out Smarter", *Club Industry,* 1 page, Approx. 1995.*

Home Gym and Fitness, "*Inside Sports"*, 1 page, Spring 1996.*

*Health & Fitness Business Buyer's Guide,* "Commerical Market In Store For Surprise", 2 page,*

Home Gym and Fitness, Inside Sports, "The New Cardio Machines" Easy on the Body, Good for the Heart , 2 pages Winter 1996.*

"Diet Wars The fads/the facts", *SHAPE,* 1 page, Feb. 1996.*

Article from *Delaware State News,* "Newest fitness stuff goes on display", Marilyn Preston, 1 page, Jul. 31, 1996.*

*North Coast Sports,* vol. 3, Issue 8, 1 page (appears to be the cover), Sep. 1996.*

Sporting Goods, *Machine Design,* Oct. 10, 1996.*

*Men's Fitness,* "It's a stairmill. . . It's a treadclimber. . . It's an EFX", 2 pages Nov. 1996.*

*Fitness Products News,* "Zero Impact Excerise", 2 pages, Nov./Dec. 1996.*

Article from *Poughkeepsie Journal,* "Fitness machine flurry can be confusing", Allison Simmons, 1 page, Jan. 16, 1997.*

*Health & Fitness,* "Less Pain for the Gain", 1 page, Feb. 24, 1997.

"on mean machine" relating to Precor Elliptical trainers, *SHAPE* , 1 page, Mar. 1997.

Bacon's, "Spin to it!", "Fitness New excercise machines that employ elliptical movements are a hot item at health clubs", 1 page, Jun. 4, 1997.

*Time digital,* "How best to break a HIGH–TECH sweat?", relates to Precor EFX, 1 page, Jul./Aug. 1997.

Cincinnati Enquirer, "Elliptical cross–trainers, outpacing traditional climbers", 1 page, Aug. 20, 1997.

The San Diego Union–Tribune, "New machines prove popular with gym rats", 1 page, Nov. 5, 1997.

*Health & Fitness Business Buyer's Guide,* Cardiovascular, "Changing of the Guard", 2 pages, Jun. 1999.

Tapis de Marche Instructions de Service, TMS, Oct. 1988.

"Schwinn Fitness Harness the Force of Nature and You Possess the Strenght of Confidence", Schwinn Cycling & Fitness, Inc., catalog, 30 pages, 1996.

* cited by examiner

COMBINATION OF TREADMILL AND STAIR CLIMBING MACHINE

FIELD OF THE INVENTION

The present invention relates to a combination of treadmill and stair climbing machine, and the combination requires only simple mechanism which effectively reduces manufacturing cost.

BACKGROUND OF THE INVENTION

A conventional combination "A" of treadmill and stair climbing machine is shown in FIGS. 6, 6A, 6B and 6C, and generally includes a frame 50 with two posts 20 connected to two sides of a front end of the frame 50 and a U-shaped handle 30 is connected to the two posts 20. Two rollers 70 are connected to a rear end of the frame 50 and driven by a wheel 71 which is driven by a motor "C". An L-shaped plate 9 is connected to the rear end of the frame 50 and supports the shafts of the two rollers 70. Two pedals 10 respectively connected to the two rollers 70 and each pedals 10 has a running belt "B" reeving the roller 70 and a front end of the pedal 10. Two hydraulic cylinders 40 are respectively connected between the two pedals 10 and two connection ports 41 on the two posts 20. Each pedal 10 has an extension 8 connected to an underside thereof and a swing mechanism 80 is connected to the two pedals 10 so that when the combination is set to be a stair climbing machine as shown in FIG. 6A, the two pedals 10 can be alternately stepped downward at the front end thereof. A T-shaped switch member 1 is connected to the front end of the frame 50 and one of two ends of its transverse bar is pivotably connected to a link 3 which is connected to a support frame 4 on which two support pieces 5 are located. Two springs 6 are respectively connected between the two support pieces 5 and the frame 50. Each extension 8 has a block 7 connected to a distal end thereof so that when operating the T-shaped switch member 1 to the position as shown in FIG. 6, the blocks 7 are supported on the support pieces 5. At this position, the two pedals 10 cannot be pivoted about the rollers 70 and are used as a treadmill.

It is noticed that the structure for transferring the treadmill and stair climbing machine, including the T-shaped switch member 1, the link 3, the support frame 4, the support pieces 5, the blocks 7, and the extensions 8, is too complicated and costly. Besides, the two pedals 10 are supported by the rollers 70 which are easily to be off-centered and this could damage the motor "C".

SUMMARY OF THE INVENTION

In accordance with one aspect of the present invention, there is provided a combination of treadmill and stair climbing machine, and the combination comprises a frame with two posts extending from two sides thereof and a handle is connected between the two posts. Two hydraulic cylinders are connected to the posts and two pedals. Two lugs are connected on the two sides of a rear end of the frame and a roller is connected between the two lugs. A wheel is connected to the roller and driven by a motor.

The two pedals each have a connection plate on a side thereof and the two connection plates are connected to the lugs. Each pedal includes a running belt which reeves through the roller and a front end of each pedal. A switch member is pivotably connected to a U-shaped frame connected to the front end of the frame and the switch member can be optionally positioned at a horizontal position when the two pedals are used as stair climbing machine, and an inclined position when the two pedals are used as a treadmill. A first spring is connected between an underside of the switch member and the frame. A swing mechanism is pivotably connected to the frame and the two pedals.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
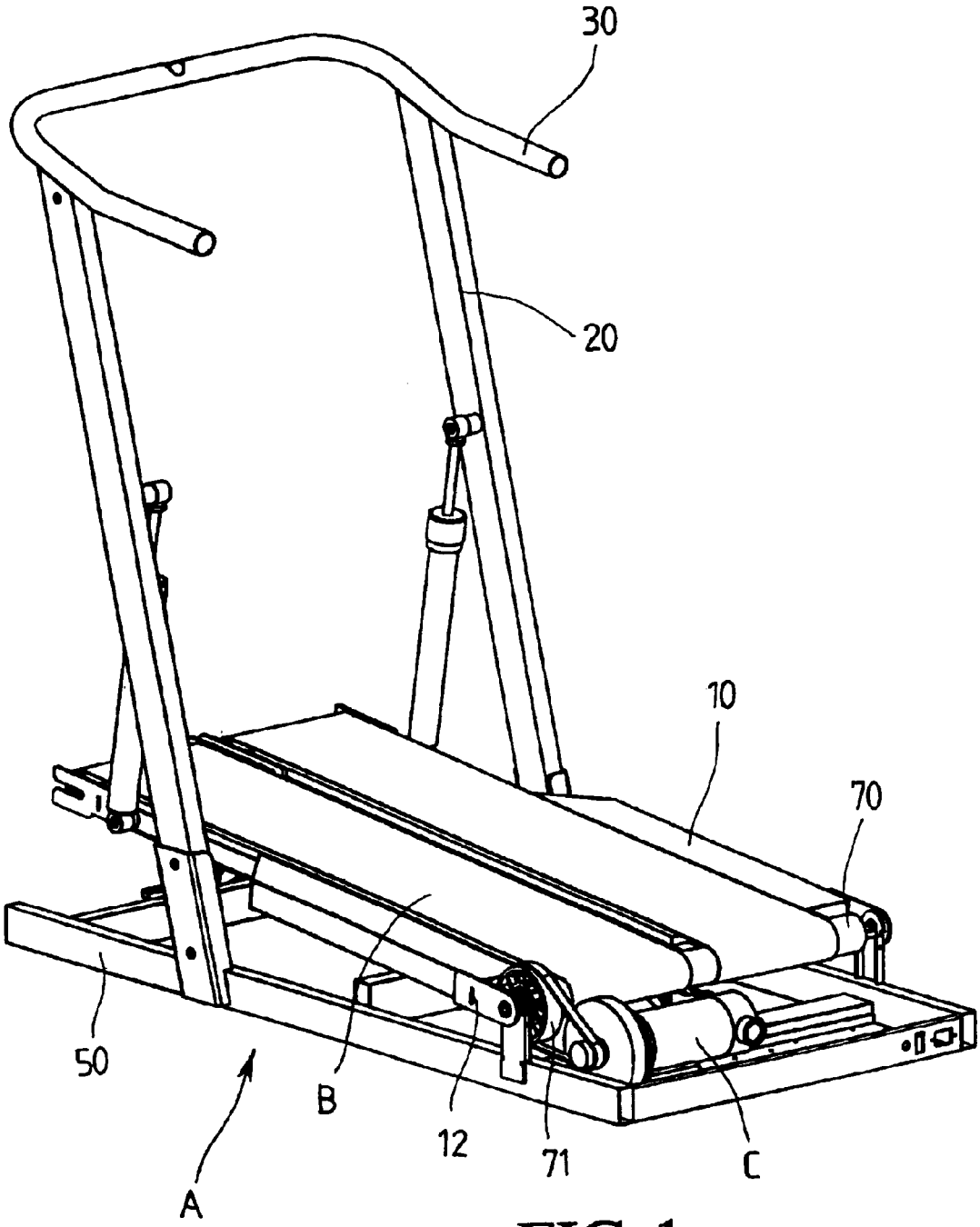
FIG. 1 is a perspective view to show the combination of treadmill and stair climbing machine of the present invention.
Figure 2:
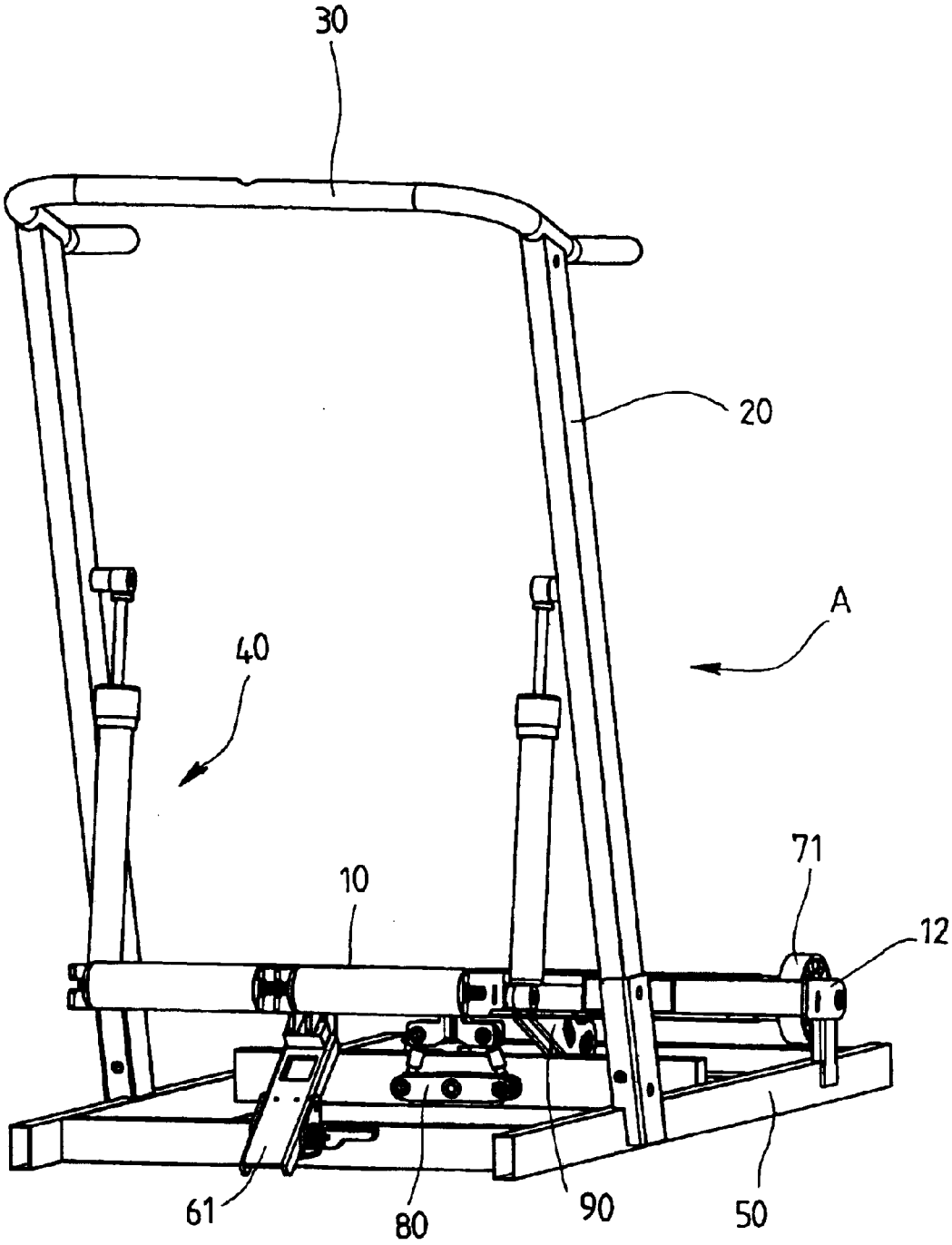
FIG. 2 is a perspective view, viewed from a front end of the combination of treadmill and stair climbing machine of the present invention.

Referring to FIGS. 1, 2, 3 and 3A, the combination "A" of treadmill and stair climbing machine of the present invention comprises a frame 50 with two posts 20 extending from two sides of a front end of the frame 50 and a handle 30 is connected between the two posts 20. Two lugs 54 are connected on the two sides of a rear end of the frame 50 and a roller 70 with a shaft 701 therein is connected between the two lugs 54. A wheel 71 is connected to the roller 70 and driven by a motor "C". An L-shaped plate 53 is connected to a transverse bar 53 of the frame 50 and two protrusions (FIGS. 3B and 3C) extending from each of two sides thereof.

Figure 3:
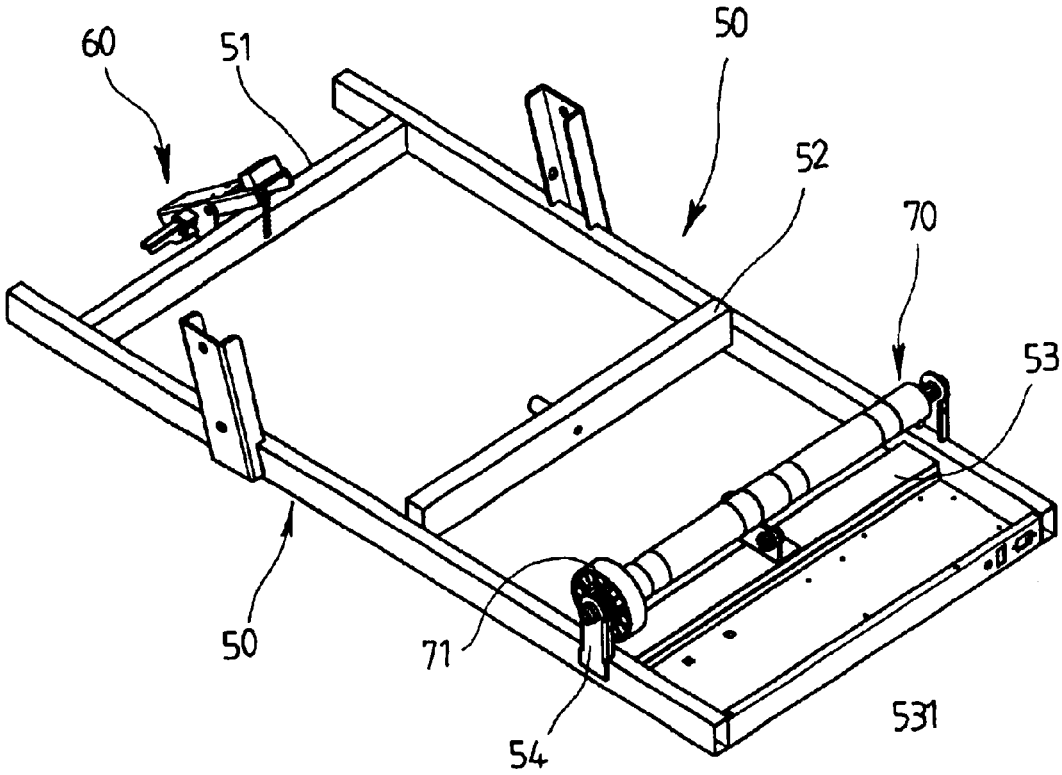
FIG. 3 shows the frame, the roller and the switch member on the frame of the present invention.
Figure 3A:
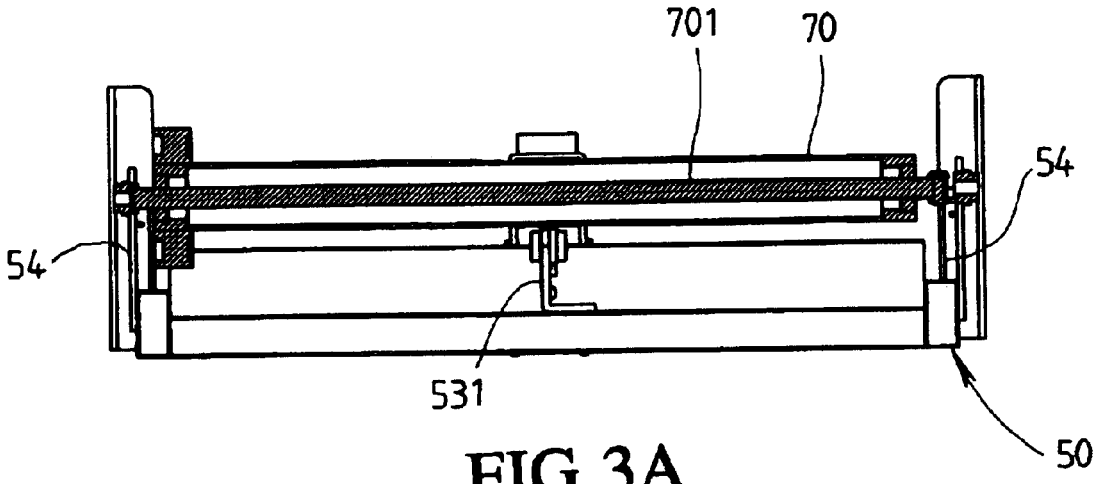
FIG. 3A shows the roller and the shaft in the roller.
Figure 3B:
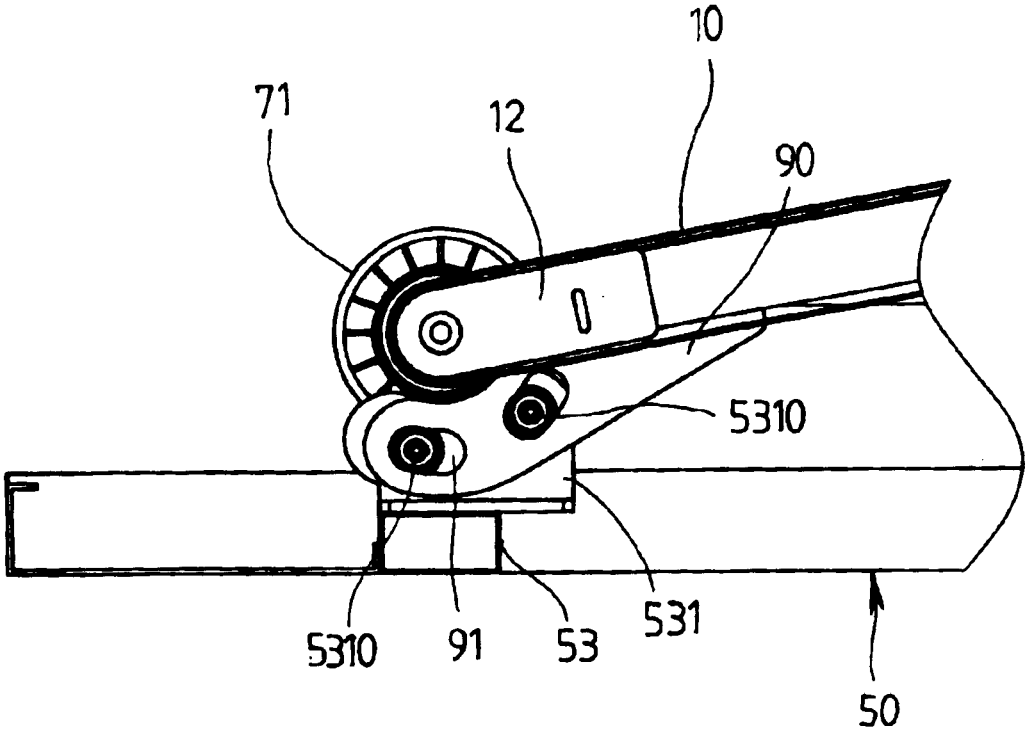
FIGS. 3B and 3C show the protrusions on the L-shaped plate movably engaged with elongate holes in the connection plates of the pedals.
Figure 3C:
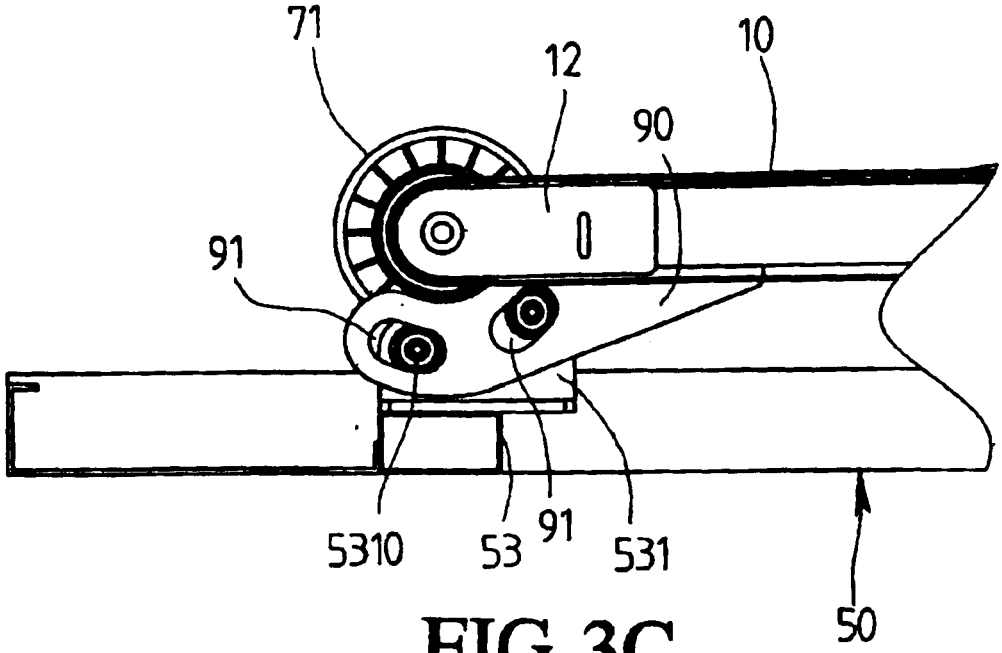

Two pedals 10 each have a connection plate 12 on a side thereof and the two connection plates 12 are connected to the lugs 54. Two hydraulic cylinders 40 are respectively connected between the two posts 20 and the two pedals 10. Each pedal 10 includes a running belt "B" which reeves through the roller 70 and a front end of each pedal 10. Each pedal 10 has a connection plate 90 which has two elongate holes 91 and the two protrusions 5310 are movably engaged with the two elongate holes 91 of each connection plate 90 as shown in FIGS. 3B and 3C when the pedals 10 are set in different function positions.

A switch member 61 is pivotably connected to a U-shaped frame 60 connected to a transverse bar 51 of the front end of the frame 50. The switch member 61 can be positioned at a horizontal position when the two pedals 10 are used as stair climbing machine, and an inclined position when the two pedals 10 are used as a treadmill. A first spring 66 is connected between an underside of the switch member 61 and the frame 50.

Figure 4:
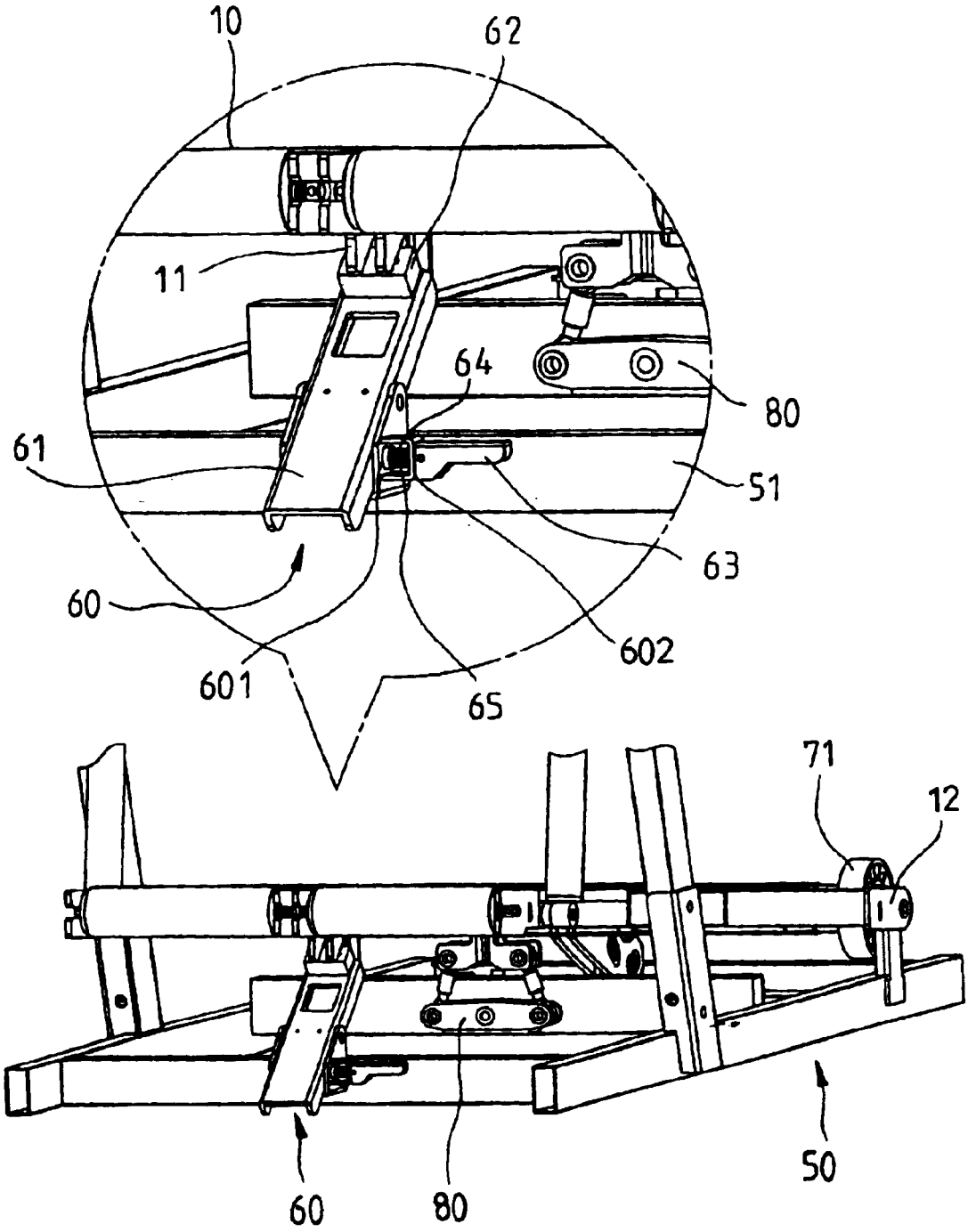
FIG. 4 shows the structure of the switch member and the U-shaped frame.
Figure 4A:
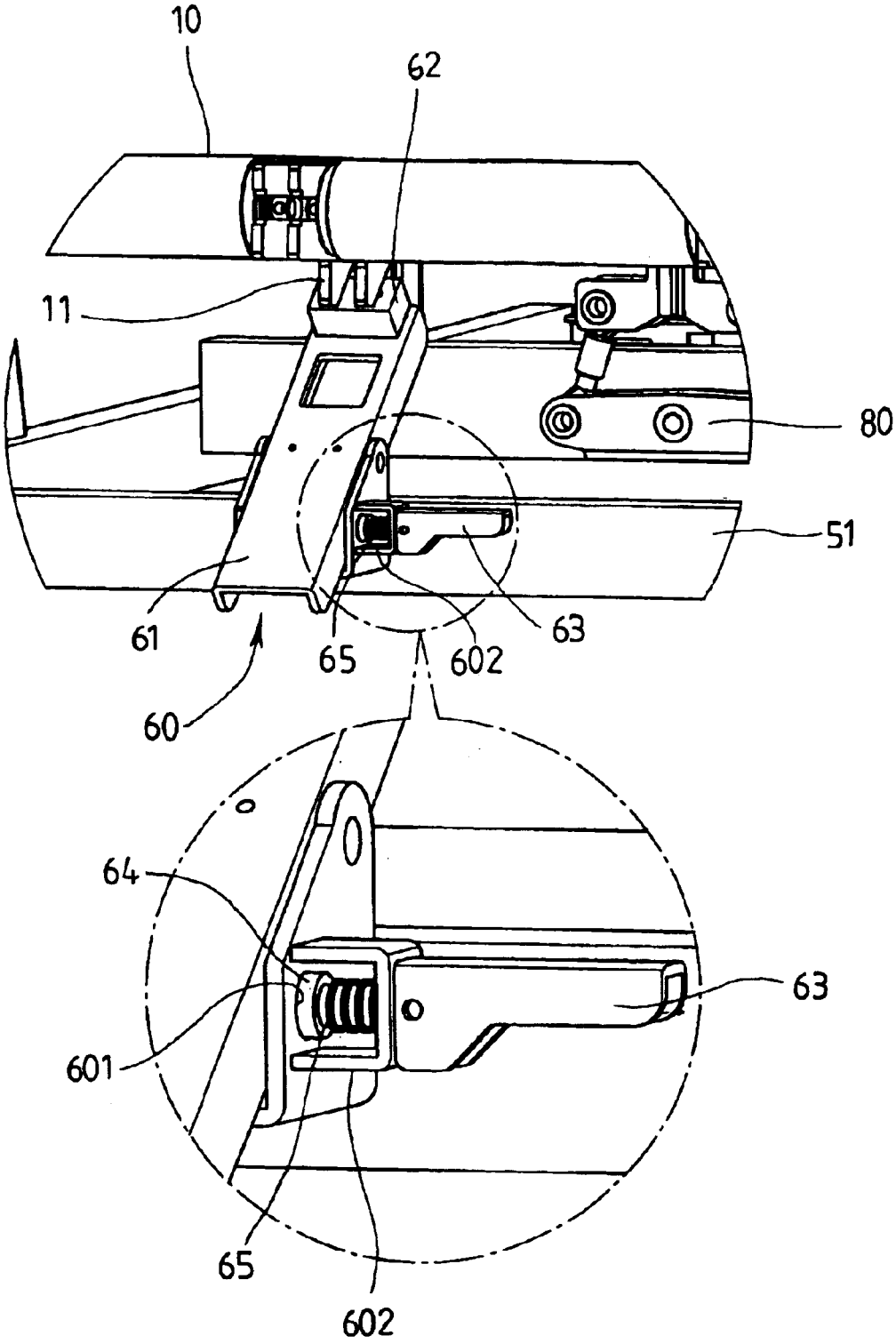
FIG. 4A shows the pin on the handle is inserted in the hole of the switch member.
Figure 4B:
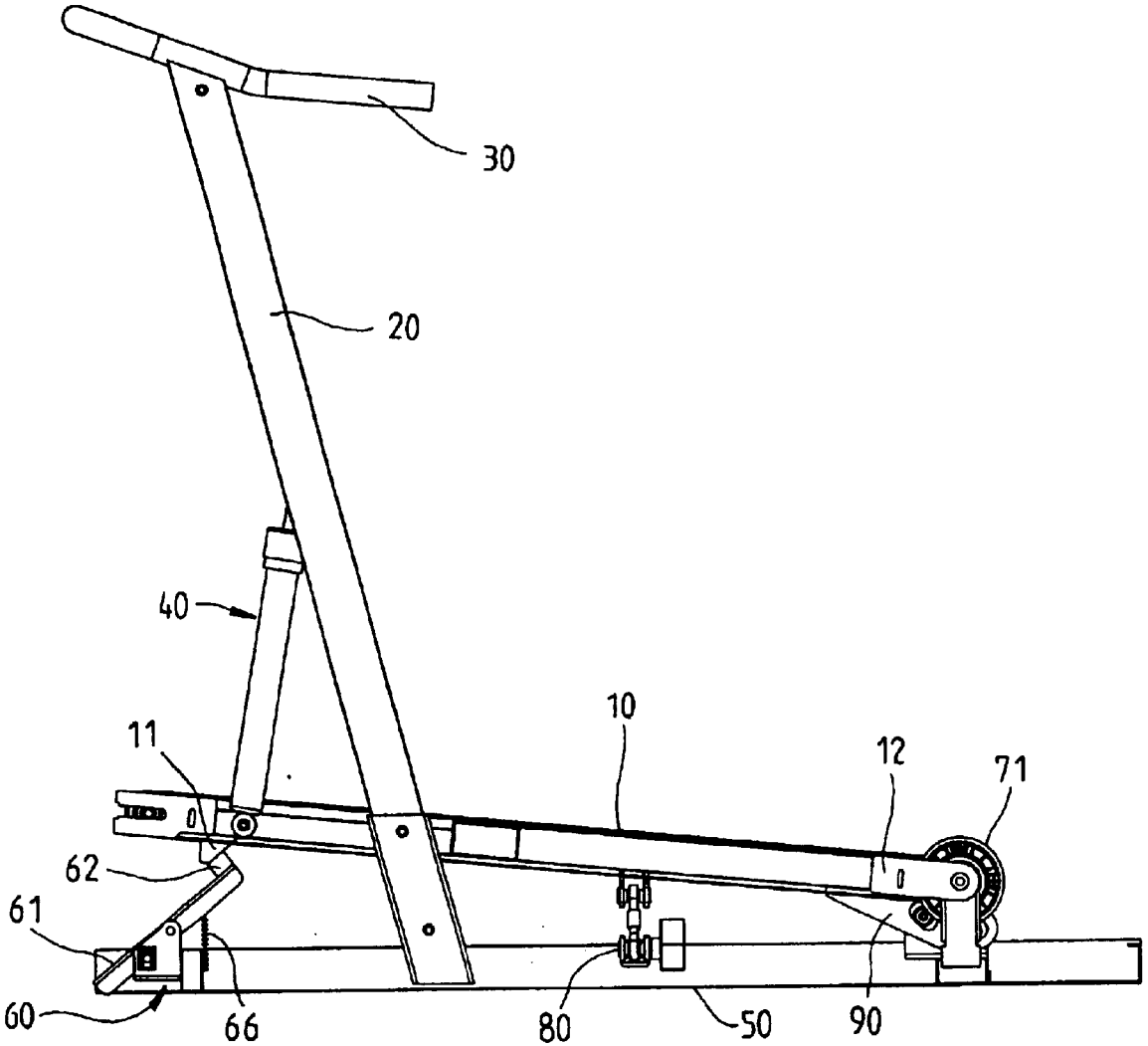
FIG. 4B shows the combination is set as a treadmill.

Further referring to FIGS. 4, 4A, 5, and 5A, a sub-frame 602 is connected to a side of one of two side plates of the U-shaped frame 60 and a handle 63 having a cam head is pivotably connected to a pin 64 which extends through the sub-frame 602 and a first hole 601 defined through the side plate of the U-shaped frame 60. A second spring 65 is mounted to the pin 64 and biased between the side plate of the U-shaped frame 60 and the sub-frame. The switch member 61 has an extension which has a second hole 611 defined therethrough, so that the pin 64 can be inserted in the second hole 611 when the switch member 611 is set in the inclined position as shown in FIGS. 4, 4A and 4B. Each pedal 10 includes a tongue 11 on an underside thereof and the support member 10 includes a block 62 on a top thereof. Each tongue 11 includes an inclined side which is rested on a top of the block 62 when the switch member 61 is set in the inclined position.

Figure 5:
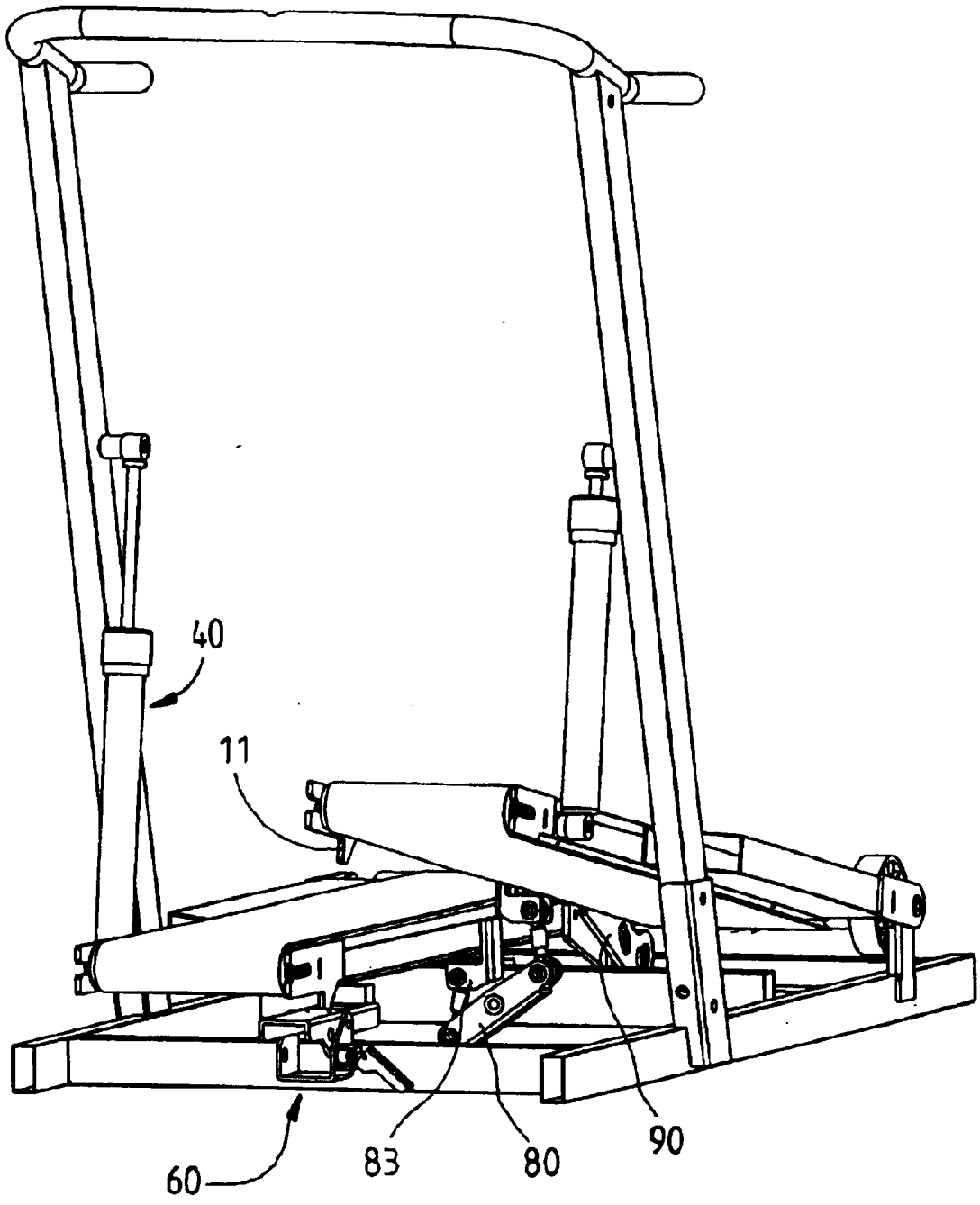
FIG. 5 shows the combination is set as a stair climbing machine.
Figure 5A:
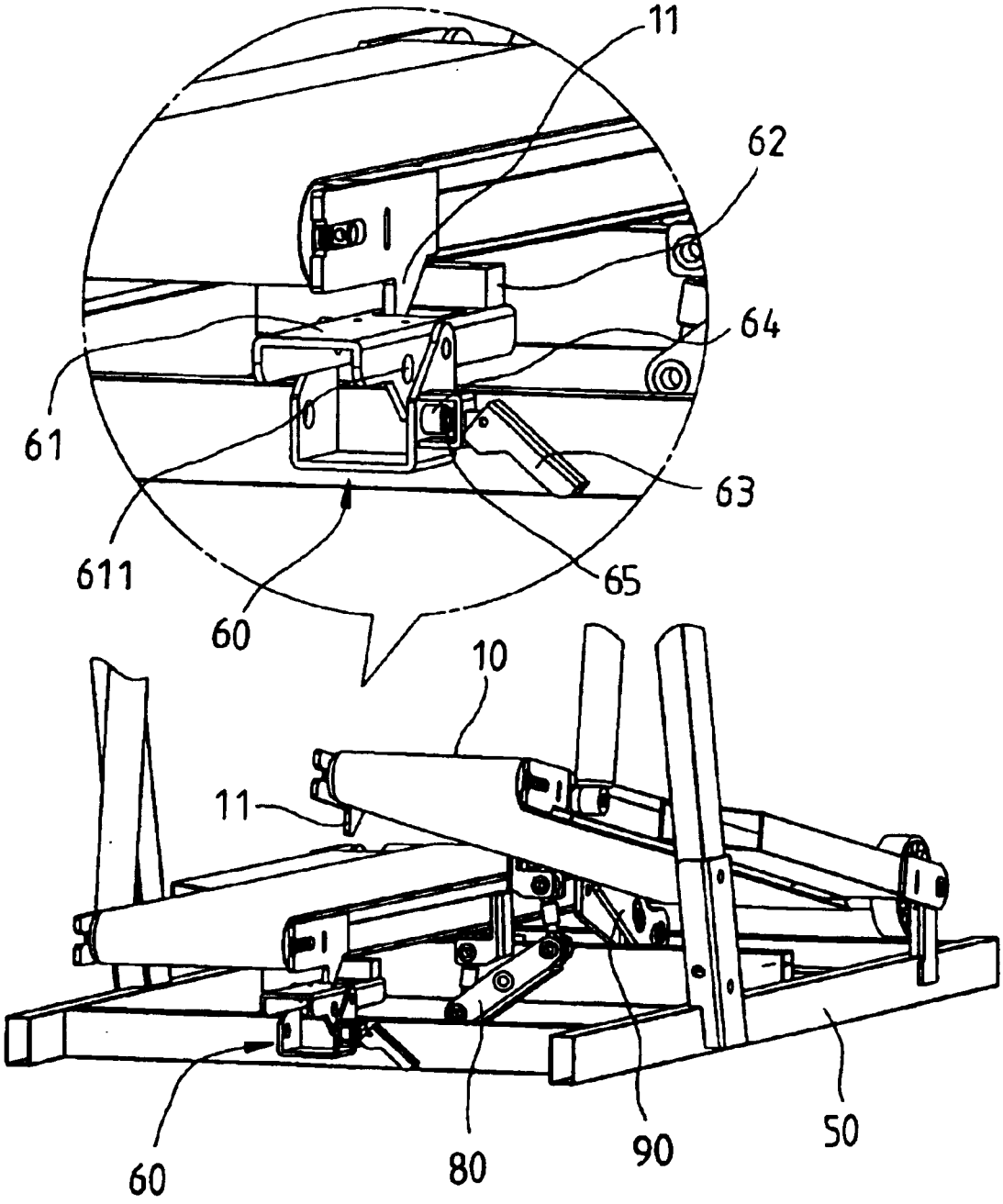
FIG. 5A shows the switch member is set when the combination is set as a stair climbing machine.
Figure 5B:
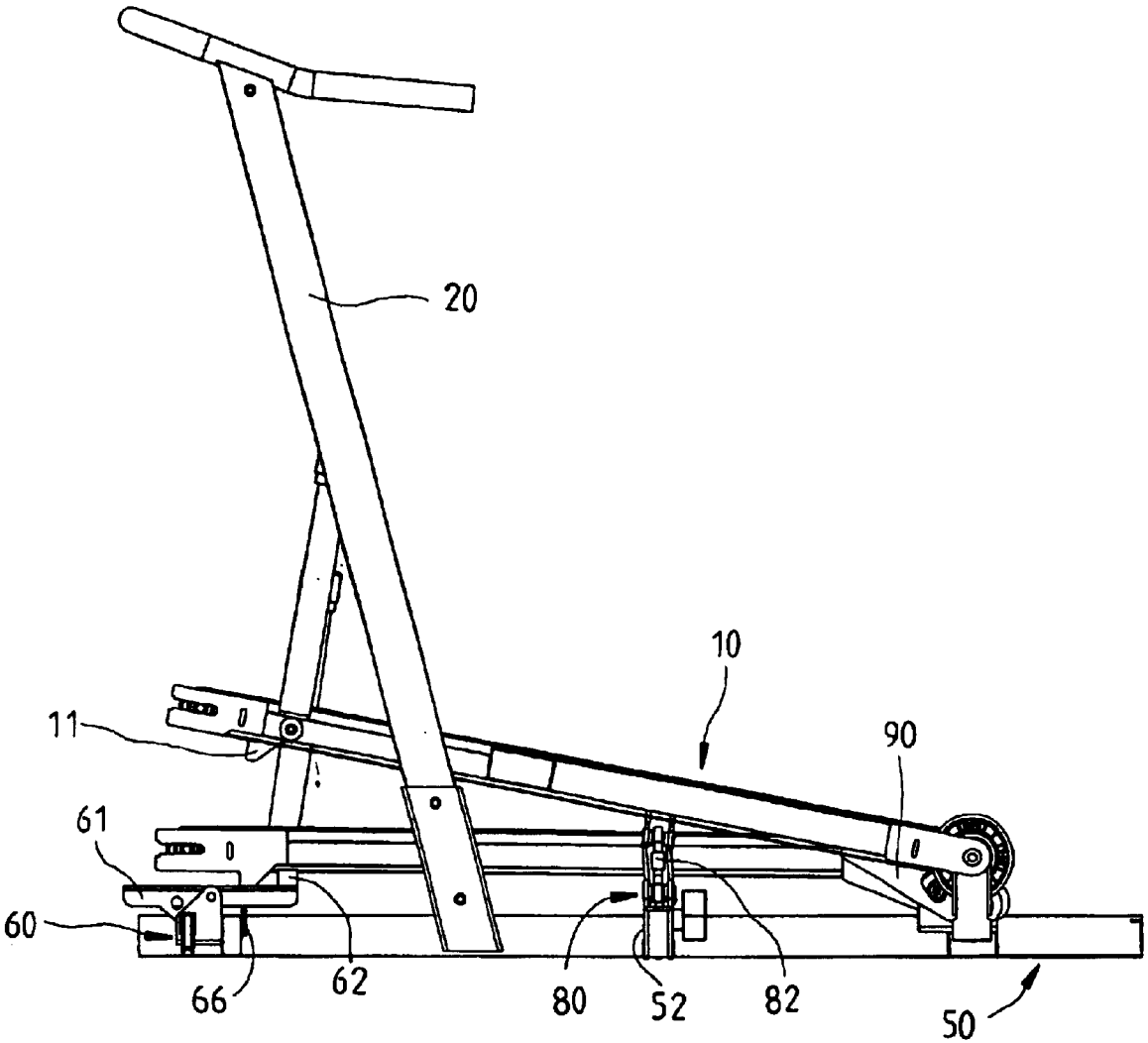
FIG. 5B shows that the combination is set as a stair climbing machine.

As shown in FIGS. 5, 5A and 5B, when the handle 63 are pivoted to pull the pin 64 from the second hole 611 in the switch member 61, and the switch member 61 is pivoted to horizontal position, the spring 66 holds the switch member 61.

Figure 4C:
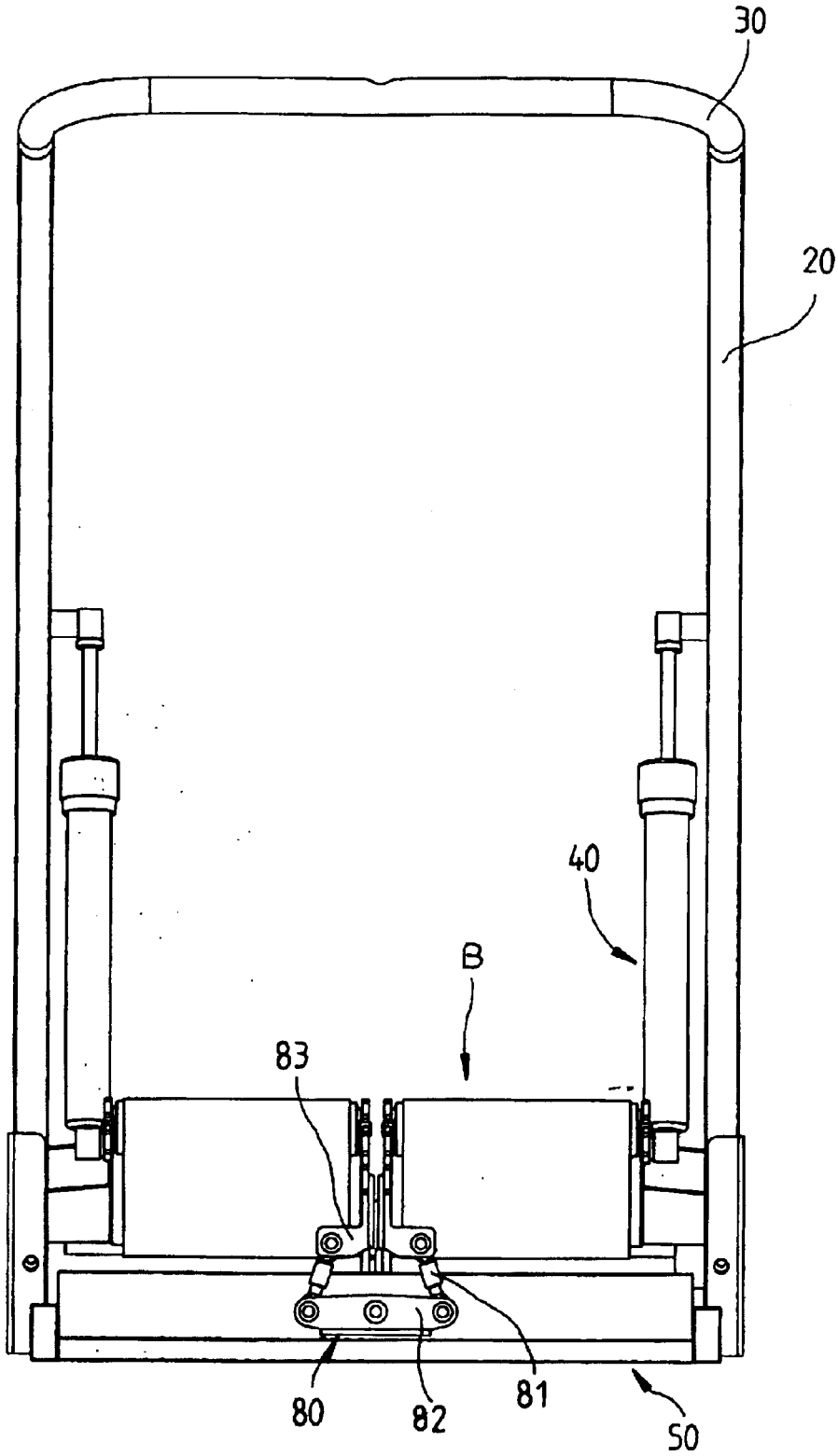
FIG. 4C shows the swing mechanism connected to the two pedals.
Figure 5C:
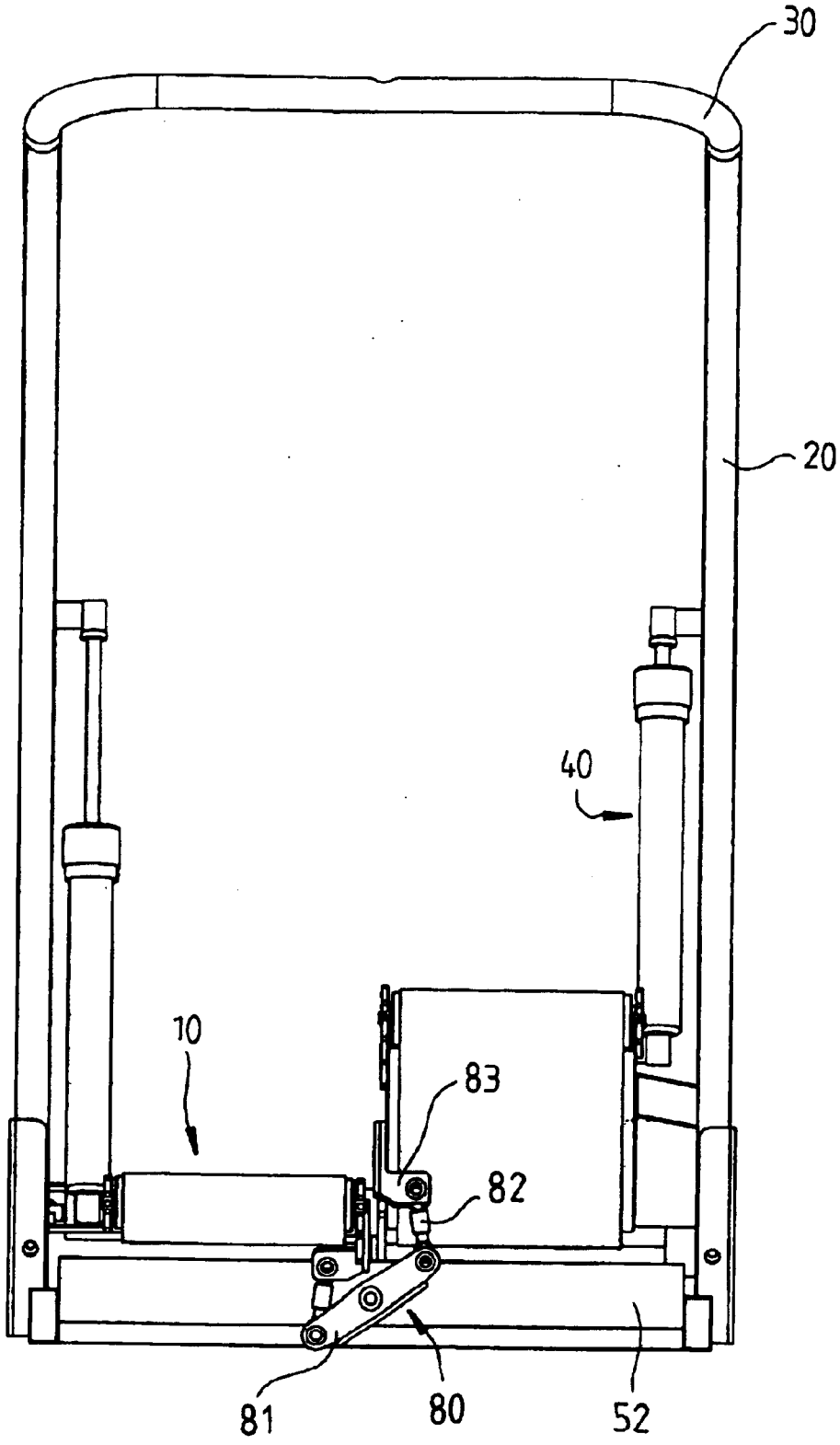
FIG. 5C shows that the swing mechanism is operated when combination is set as a stair climbing machine.
Figure 6:
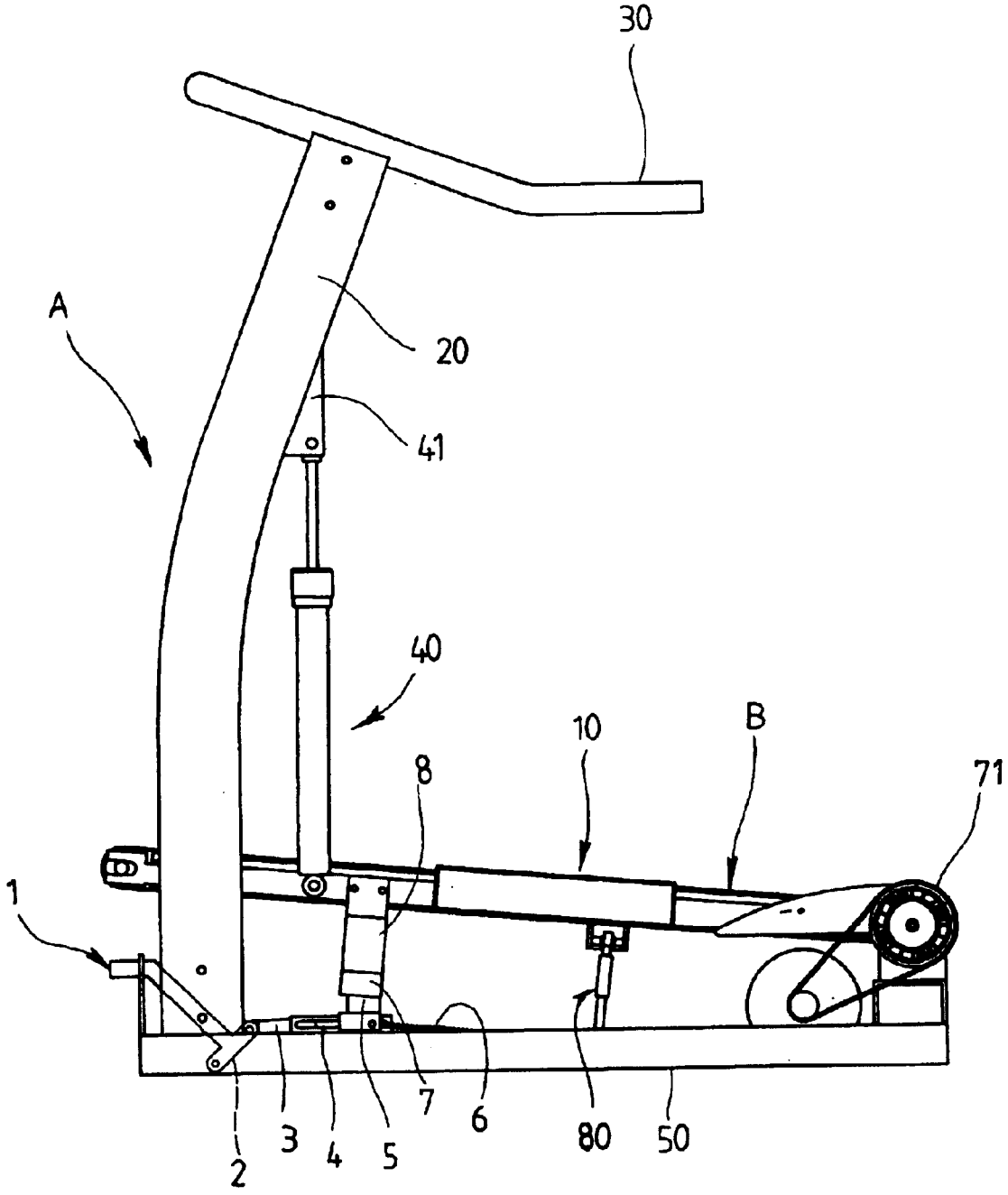
FIG.6 PRIOR ART
FIG. 6 is a side view to show a conventional combination of treadmill and stair climbing machine.
Figure 6A:
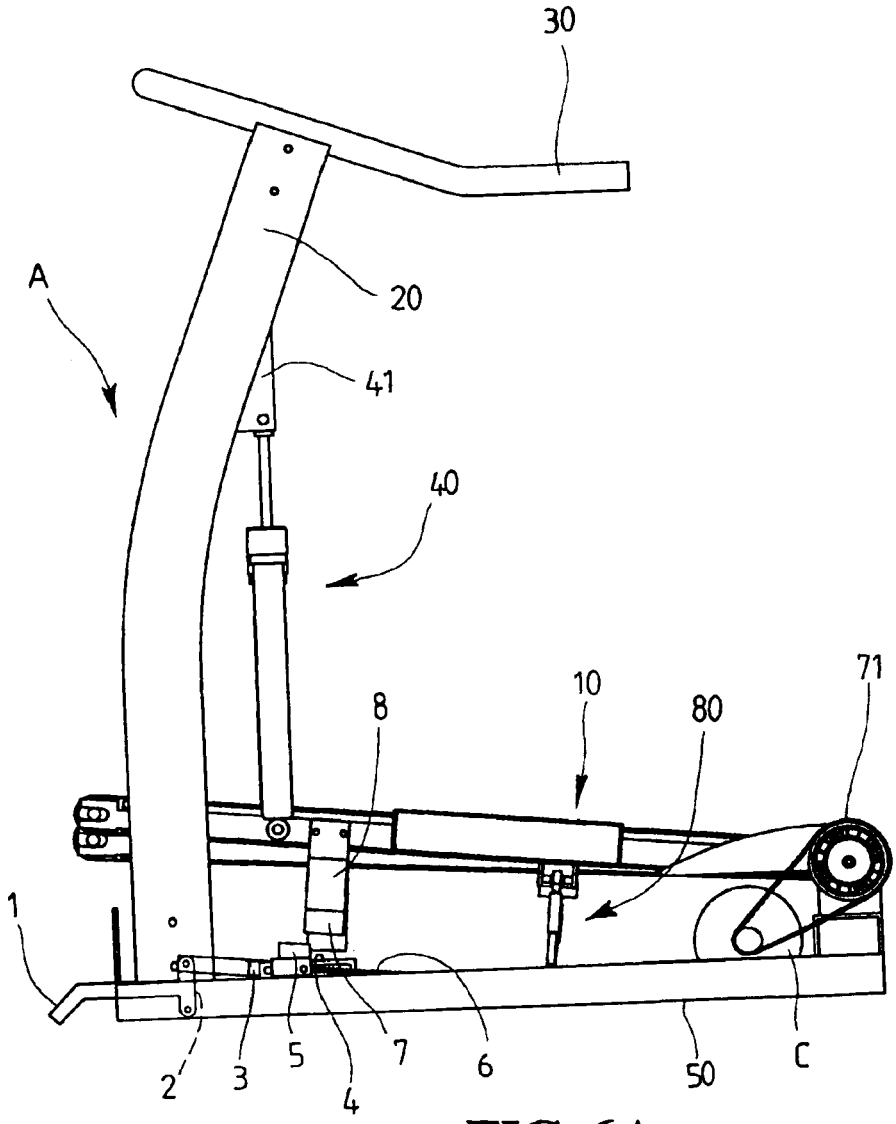
FIG.6A PRIOR ART
FIGS. 6A and 6B shows the frame and the two rollers of the conventional combination.
Figure 6B:
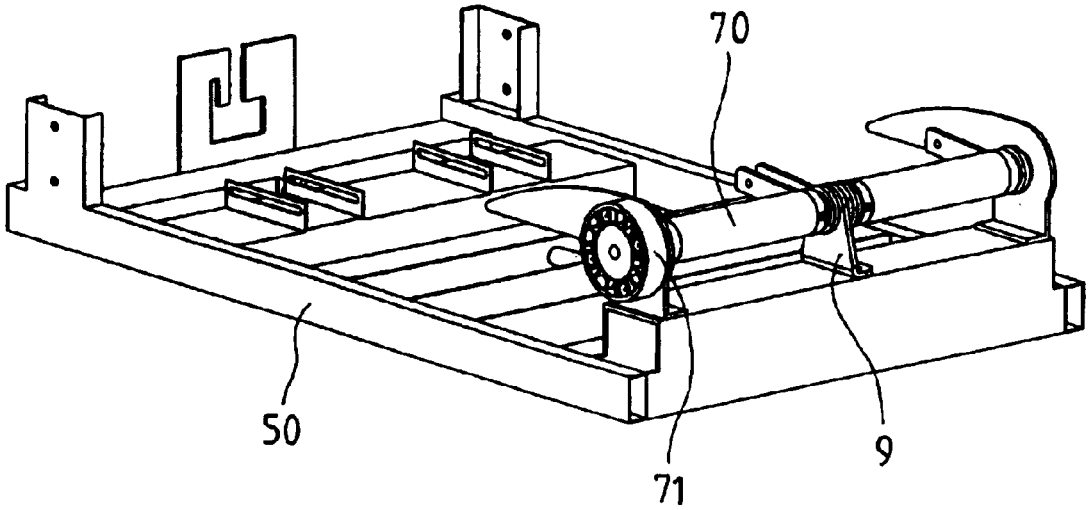
FIG.6B PRIOR ART
Figure 6C:
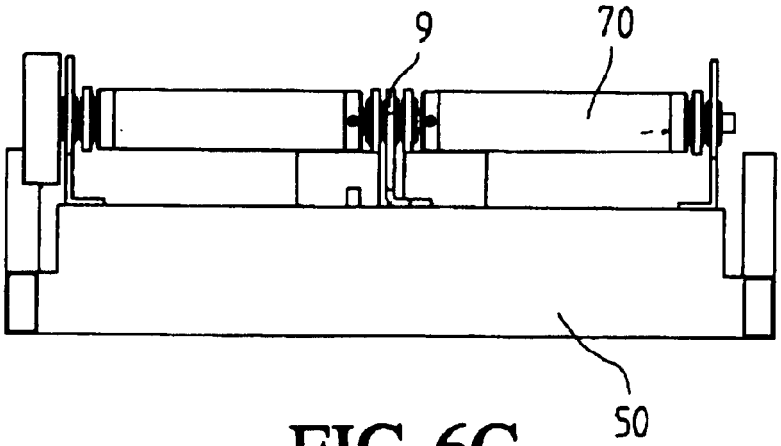
FIG.6C PRIOR ART
FIG. 6C shows the rear end view of the two rollers of the conventional combination.

Further referring to FIG. 4C, a swing mechanism 80 is pivotably connected to the frame 50 and the two pedals 10 so as to allow the two pedals 10 to be operated as a stair climbing machine. As shown in FIG. 5C, the swing mechanism 80 includes a main link 81 which has a intermediate point pivotably connected to a transverse bar 52 of the frame 50 and two sub-links 82 are respectively connected between the two ends of the main link 81 and two respective plates 83 connected to the two pedals 10.

The load of the pedals 10 are supported on the shaft 701 of the roller 70 and there is only one roller 70 so that the shortcoming of the conventional combination is improved. The operation of the switch member 61 is convenient to set the pedals 10 to be treadmill or stair climbing machine.

While we have shown and described the embodiment in accordance with the present invention, it should be clear to those skilled in the art that further embodiments may be made without departing from the scope of the present invention.

What is claimed is:

1. A combination of treadmill and stair climbing machine, comprising:

a frame with two posts extending from two sides of a front end of the frame and a handle connected between the two posts, two lugs connected on the two sides of a rear end of the frame and a roller connected between the two lugs, a wheel connected to the roller and driven by a motor;

two pedals each having a connection plate on a side thereof and the two connection plates connected to the lugs, two hydraulic cylinders respectively connected between the two posts and the two pedals, each pedal including a running belt which reeves through the roller and a front end of each pedal;

a switch member pivotably connected to a U-shaped frame connected to the front end of the frame and the switch member being positioned at a horizontal position when the two pedals are used as a stair climbing machine, and an inclined position when the two pedals are used as a treadmill, a first spring connected between an underside of the switch member and the frame;

a swing mechanism pivotably connected to the frame and the two pedals; and wherein a sub-frame is connected to a side of one of two side plates of the U-shaped frame and a handle having a cam head which is pivotably connected to a pin which extends through the sub-frame and a first hole defined through the side plate, a second spring mounted to the pin and biased between the side plate of the U-shaped frame and the sub-frame, the switch member having an extension which has a second hole defined therethrough, the pin being inserted in the second hole when the switch member is set in the inclined position.

2. A combination of treadmill and stair climbing machine, comprising:

a frame with two posts extending from two sides of a front end of the frame and a handle connected between the two posts, two lugs connected on the two sides of a rear end of the frame and a roller connected between the two lugs, a wheel connected to the roller and driven by a motor;

two pedals each having a connection plate on a side thereof and the two connection plates connected to the lugs, two hydraulic cylinders respectively connected between the two posts and the two pedals, each pedal including a running belt which reeves through the roller and a front end of each pedal;

a switch member pivotably connected to a U-shaped frame connected to the front end of the frame and the switch member being positioned at a horizontal position when the two pedals are used as a stair climbing machine, and an inclined position when the two pedals are used as a treadmill, a first spring connected between an underside of the switch member and the frame;

a swing mechanism pivotably connected to the frame and the two pedals; and wherein each pedal includes a tongue on an underside thereof and the support member includes a block on a top thereof, each tongue including an inclined side which is rested on a top of the block when the switch member is set in the inclined position.

3. A combination of treadmill and stair climbing machine, comprising:

a frame with two posts extending from two sides of a front end of the frame and a handle connected between the two posts, two lugs connected on the two sides of a rear end of the frame and a roller connected between the two lugs, a wheel connected to the roller and driven by a motor;

two pedals each having a connection plate on a side thereof and the two connection plates connected to the lugs, two hydraulic cylinders respectively connected between the two posts and the two pedals, each pedal including a running belt which reeves through the roller and a front end of each pedal;

a switch member pivotably connected to a U-shaped frame connected to the front end of the frame and the switch member being positioned at a horizontal position when the two pedals are used as a stair climbing machine, and an inclined position when the two pedals are used as a treadmill, a first spring connected between an underside of the switch member and the frame;

a swing mechanism pivotably connected to the frame and the two pedals; and an L-shaped plate connected to the frame and each pedal has a connection plate which has two elongate holes, the L-shaped plate having two protrusions on each of two sides thereof, the two protrusions movably engaged with the two elongate holes of each connection plate.

* * * * *

UNITED STATES PATENT AND TRADEMARK OFFICE

CERTIFICATE OF CORRECTION

PATENT NO. : 7,097,593 B2
APPLICATION NO. : 10/637628
DATED : August 29, 2006
INVENTOR(S) : Dick Chang It is certified that error appears in the above-identified patent and that said Letters Patent is hereby corrected as shown below:

Title page, Item (56), References Cited, U.S.PATENT DOCUMENTS, insert the following:

--2004/0214693 A1 10/28/2004 Piaget et al.--

Title page, Item (56), References Cited, OTHER PUBLICATIONS, page 7, line 39, delete "On" and insert --One--.

Signed and Sealed this

Twentieth Day of March, 2007

JON W. DUDAS
*Director of the United States Patent and Trademark Office*